US011762311B2

(12) United States Patent
Wakizaka et al.

(10) Patent No.: US 11,762,311 B2
(45) Date of Patent: Sep. 19, 2023

(54) DRUM UNIT ATTACHABLE TO IMAGE FORMING APPARATUS AND INCLUDING TONER CARTRIDGE HAVING TONER MEMORY INCLUDING THREE TERMINALS

(71) Applicant: BROTHER KOGYO KABUSHIKI KAISHA, Nagoya (JP)

(72) Inventors: Masaaki Wakizaka, Nagoya (JP); Shinta Sugiura, Nagoya (JP); Shunsuke Aiba, Toyoake (JP); Keita Inoue, Konan (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/852,760

(22) Filed: Jun. 29, 2022

(65) Prior Publication Data

US 2023/0004102 A1 Jan. 5, 2023

(30) Foreign Application Priority Data

Jun. 30, 2021 (JP) ..... 2021-108873

(51) Int. Cl.
*G03G 15/20* (2006.01)
*G03G 15/08* (2006.01)

(52) U.S. Cl.
CPC ..... *G03G 15/0863* (2013.01)

(58) Field of Classification Search
CPC ..... G03G 15/00; G03G 15/0863; G03G 15/20
USPC ..... 399/9, 12, 90, 107, 110, 111
See application file for complete search history.

(56) References Cited

U.S. PATENT DOCUMENTS 10,845,754 B2 * 11/2020 Yabuki ..... G03G 21/1652
11,392,084 B2 * 7/2022 Sugiura ..... G03G 15/80
2017/0219997 A1 8/2017 Kim

FOREIGN PATENT DOCUMENTS

JP 2001-337579 A 12/2001
JP 2006-171105 A 6/2006
JP 2013-218199 A 10/2013
WO 2021/171642 A1 9/2021

* cited by examiner

*Primary Examiner* — Hoan H Tran
(74) *Attorney, Agent, or Firm* — Merchant & Gould P.C.

(57) ABSTRACT

A drum unit detachably attachable to an image forming apparatus includes: a frame; a photosensitive drum; a toner cartridge including a toner casing and a toner memory; a connector electrically connected to the image forming apparatus; and a relay board electrically relaying the toner memory and the connector. The toner memory performs communication according to a standard that sets a value of data on a basis of a voltage for data communication at a timing when a prescribed period of time has elapsed since the voltage has made a prescribed change. The toner memory consists of three terminals as electrical contacts. The three terminals are a power supply terminal for supplying a supply voltage to the toner memory, a ground terminal, and a data terminal for communication of data to be written into the toner memory and data to be read from the toner memory.

13 Claims, 15 Drawing Sheets

FIRST DIRECTION
CONTROLLER
1
10
10A
11
12
20
21
22
30
40
50
51
52
53
54
55
61
62
63
64
65
70
71
72
73
74
80
81
82
90
91
100
S
TC
TM
CA

DRUM UNIT ATTACHABLE TO IMAGE FORMING APPARATUS AND INCLUDING TONER CARTRIDGE HAVING TONER MEMORY INCLUDING THREE TERMINALS

CROSS REFERENCE TO RELATED APPLICATIONS

This application claims priority from Japanese Patent Application No. 2021-108873 filed Jun. 30, 2021. The entire content of the priority application is incorporated herein by reference.

BACKGROUND

Conventionally, there has been known an image forming apparatus including a main body, a drum unit, and a toner cartridge. The toner cartridge is attachable to and detachable from the main body. The drum unit is attachable to and detachable from the main body independently of the toner cartridge. The drum unit includes a developing container configured to accommodate therein carrier. The main body includes a toner supply unit for supplying toner in the toner cartridge into the developing container.

Also known is a developing cartridge including a memory or another storage medium for managing a lifetime and the like of the developing cartridge. When the developing cartridge is attached to an image forming apparatus, electrical connection between the developing cartridge and the image forming apparatus is established to enable communication of data therebetween.

SUMMARY

In a case where a toner memory is provided at a toner cartridge attachable to a drum unit, the drum unit and the toner memory are electrically connected to each other so that data in the toner memory can be transmitted to an image forming apparatus via the drum unit. For this reason, it is preferable that the number of terminals used as electrical contacts for the toner memory is small to avoid complication of the wiring in the drum unit.

In view of the foregoing, it is an object of the present disclosure to provide a drum unit that is attachable to and detachable from an image forming apparatus and that requires fewer electrical contacts for communication of data when a toner cartridge is attached to the drum unit.

In order to attain the above and other objects, the present disclosure provides a drum unit attachable to and detachable from an image forming apparatus. The drum unit includes: a frame; a photosensitive drum; a toner cartridge; a connector; and a relay board. The toner cartridge is attachable to and detachable from the frame of the drum unit. The toner cartridge includes: a toner casing; and a toner memory. The toner casing is configured to accommodate toner therein. The toner memory is configured to store therein information related to the toner cartridge. The toner memory consists of three terminals as electrical contacts. The three terminals are a power supply terminal for supplying a supply voltage to the toner memory, a ground terminal, and a data terminal for communication of data to be written into the toner memory and data to be read from the toner memory. The toner memory is configured to perform communication according to a standard that sets a value of data on a basis of a voltage for data communication at a timing when a prescribed period of time has elapsed since the voltage for data communication has made a prescribed change. The connector is electrically connected to the image forming apparatus when the drum unit is attached to the image forming apparatus. The relay board electrically relays the three terminals of the toner memory and the connector to transmit information stored in the toner memory to the image forming apparatus when the toner cartridge is attached to the frame of the drum unit.

With the above configuration, in the drum unit attachable to and detachable from the image forming apparatus, the toner memory includes only three terminals. Accordingly, the number of electrical contacts in the drum unit can be made small.

According to another aspect, the present disclosure also provides a drum unit attachable to and detachable from an image forming apparatus. The drum unit includes: a frame; a photosensitive drum; a toner cartridge; a connector; and a relay board. The toner cartridge is attachable to and detachable from the frame of the drum unit. The toner cartridge includes: a toner casing; and a toner memory. The toner casing is configured to accommodate toner therein. The toner memory is configured to store therein information related to the toner cartridge. The toner memory consists of three terminals as electrical contacts. The three terminals are a power supply terminal for supplying a supply voltage to the toner memory and for communicating a synchronization signal, a ground terminal, and a data terminal for communication of data. The connector is electrically connected to the image forming apparatus when the drum unit is attached to the image forming apparatus. The relay board electrically relays the three terminals of the toner memory and the connector to transmit information stored in the toner memory to the image forming apparatus when the toner cartridge is attached to the frame of the drum unit.

Even with the above configuration, the number of electrical contacts in the drum unit attachable to and detachable from the image forming apparatus can be reduced since the toner memory includes only three terminals.

According to still another aspect, the present disclosure also provides a drum unit attachable to and detachable from an image forming apparatus. The drum unit includes: a frame; a photosensitive drum; a toner cartridge; a connector; and a relay board. The toner cartridge is attachable to and detachable from the frame of the drum unit. The toner cartridge includes: a toner casing; and a toner memory. The toner casing is configured to accommodate toner therein. The toner memory is configured to store therein information related to the toner cartridge. The toner memory consists of two terminals as electrical contacts. The two terminals are a ground terminal, and a data terminal for supplying a supply voltage to the toner memory and for communication of data to be written into the toner memory and data to be read from the toner memory. The toner memory is configured to perform communication according to a standard that sets a value of data on a basis of a voltage for data communication at a timing when a prescribed period of time has elapsed since the voltage for data communication has made a prescribed change. The connector is electrically connected to the image forming apparatus when the drum unit is attached to the image forming apparatus. The relay board electrically relays the two terminals of the toner memory and the connector to transmit information stored in the toner memory to the image forming apparatus when the toner cartridge is attached to the frame of the drum unit.

With the above configuration, since the toner memory includes only two terminals, the number of electrical contacts in the drum unit that is attachable to and detachable from the image forming apparatus can be further reduced.

According to still another aspect, the present disclosure also provides an image forming apparatus to which the above-described drum unit is attachable. The image forming apparatus includes: a controller; and a wire. The wire connects the controller and the connector to each other and is configured to be electrically connected to the data terminal. A pull-up resistor is connected to the wire.

In the above configuration, since the pull-up resistor is connected to the wire, instability in potential of the wires can be suppressed.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

<First Embodiment>

Hereinafter, a first embodiment of the present disclosure will be described with reference to FIGS. 1 through 9.

Figure 1:
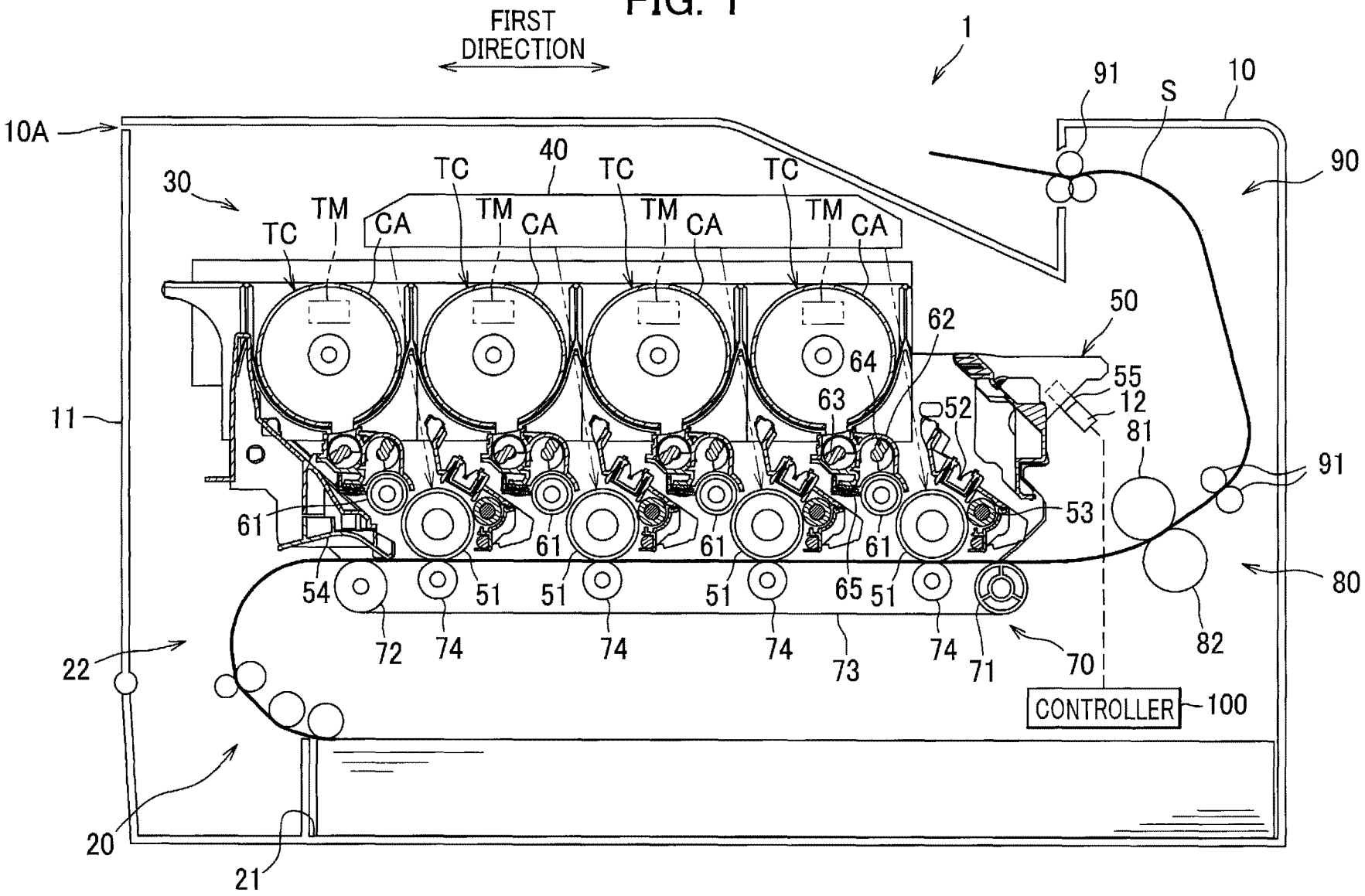
FIG. 1 is a cross-sectional view illustrating a color printer.

As illustrated in FIG. 1, a color printer 1 as an example of an image forming apparatus includes a main body 10, a sheet feeding unit 20, an image forming unit 30, a discharge unit 90, and a controller 100.

The main body 10 has an opening 10A, and includes a front cover 11 and a main connector 12. The front cover 11 is movable between an open position (a position illustrated in FIG. 3) in which the front cover 11 opens the opening 10A, and a closed position (a position illustrated in FIG. 1) in which the front cover 11 closes the opening 10A. Specifically, the front cover 11 is pivotally movable between the open position and the closed position. The main connector 12 is positioned within the main body 10. The main connector 12 is electrically connected to the controller 100.

The sheet feeding unit 20 includes a sheet tray 21, and a sheet feed mechanism 22. The sheet tray 21 is configured to accommodate therein a sheet(s) S. The sheet feed mechanism 22 is configured to convey the sheet(s) S from the sheet tray 21 to the image forming unit 30.

The image forming unit 30 includes a scanner unit 40, a drum unit 50, a transfer unit 70, and a fixing unit 80.

The scanner unit 40 includes a laser emitting portion, polygon mirrors, lenses, and reflection mirrors those are not illustrated. The scanner unit 40 is configured to irradiate surfaces of photosensitive drums 51 (described later) with laser beam.

The drum unit 50 is movable in a first direction relative to the main body 10 through the opening 10A. Specifically, the drum unit 50 is movable in the first direction between an accommodated position (a position illustrated in FIG. 1) in which the drum unit 50 is accommodated in the main body 10, and a pulled-out position (a position illustrated in FIG. 3) in which the drum unit 50 is pulled out of the main body 10. That is, the drum unit 50 is attachable to and detachable from the main body 10 of the color printer 1.

Figure 2:
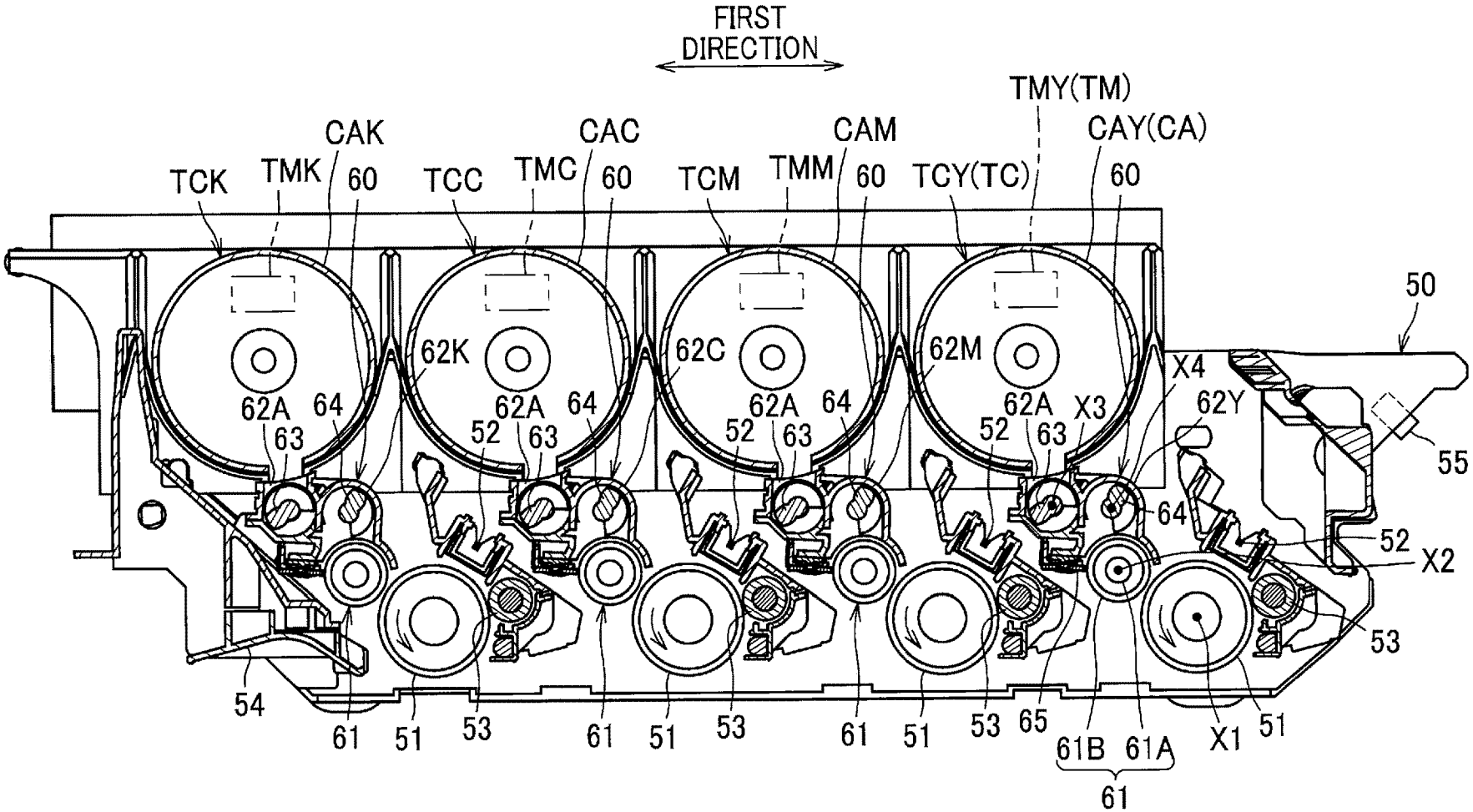
FIG. 2 is a cross-sectional view of a drum unit to which toner cartridges are attached.

As illustrated in FIG. 2, the drum unit 50 includes a plurality of photosensitive drums 51, and a plurality of developing units 60. Specifically, the drum unit 50 includes four toner cartridges TC, four photosensitive drums 51, four scorotron chargers 52, four cleaning rollers 53, four developing units 60, a sheet guide 54, and a connector 55.

Figure 3:
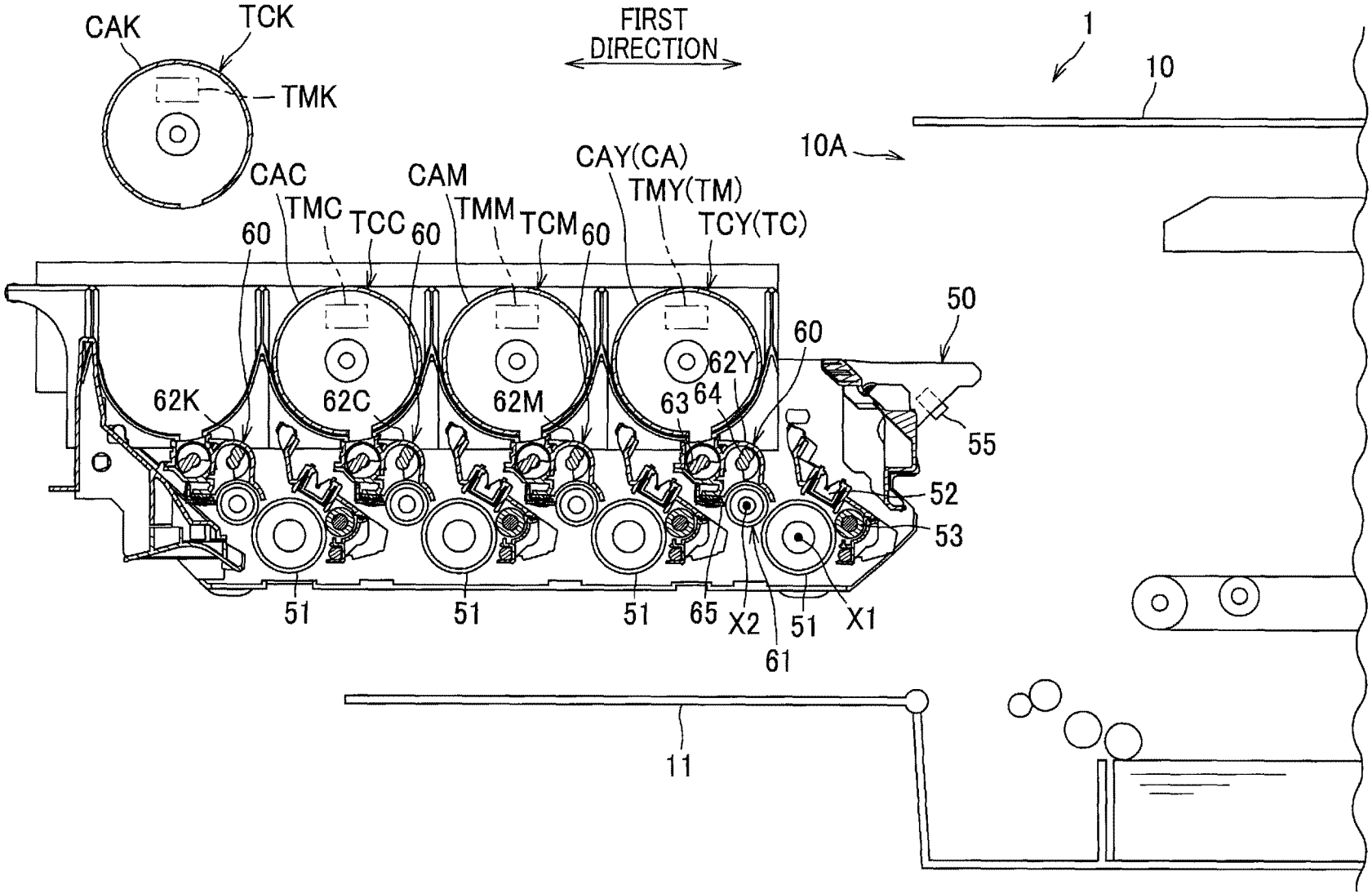
FIG. 3 is a cross-sectional view of the drum unit in its pulled-out position.

Each of the four toner cartridges TC includes a toner casing CA configured to accommodate toner therein. In the present embodiment, each of the toner cartridges TC is configured to accommodate therein toner which is non-magnetic material. As illustrated in FIG. 3, the toner cartridges TC are attachable to and detachable from a frame of the drum unit 50. Specifically, each of the toner cartridges TC is attachable to and detachable from the frame of the drum unit 50 in a direction perpendicular to an axial direction of the photosensitive drums 51 (hereinafter simply referred to as "axial direction").

In the present embodiment, the toner cartridges TC include a first toner cartridge TCY for toner of yellow (Y) color, a second toner cartridge TCM for toner of magenta (M) color, a third toner cartridge TCC for toner of cyan (C) color, and a fourth toner cartridge TCK for toner of (K) color.

Further, in the present embodiment, the toner casings CA include a first toner casing CAY corresponding to the first toner cartridge TCY, a second toner casing CAM corresponding to the second toner cartridge TCM, a third toner casing CAC corresponding to the third toner cartridge TCC, and a fourth toner casing CAK corresponding to the fourth toner cartridge TCK.

Each of the toner cartridges TC also includes a toner memory TM. Each of the toner memories TM is configured to store therein toner cartridge information related to the corresponding toner cartridge TC. Note that information detected by toner sensors 66 (described later) may be stored in the toner memories TM.

The toner cartridge information is at least one of: identification information used to identify the corresponding toner cartridge TC; and toner lifetime information for the corresponding toner cartridge TC. The identification information is, for example, a serial number. The toner lifetime information is, for example, at least one of: the cumulative number of rotations of a magnetic roller 61, the cumulative number of rotations of a first auger 63, dot counts of formed images; and a remaining quantity of toner in the toner cartridge TC.

In the present embodiment, the toner memories TM include a first toner memory TMY corresponding to the first toner cartridge TCY, a second toner memory TMM corresponding to the second toner cartridge TCM, a third toner memory TMC corresponding to the third toner cartridge TCC, and a fourth toner memory TMK corresponding to the fourth toner cartridge TCK.

The first toner memory TMY is configured to store therein first toner cartridge information related to the first toner cartridge TCY. The second toner memory TMM is configured to store therein second toner cartridge information related to the second toner cartridge TCM. The third toner memory TMC is configured to store therein third toner cartridge information related to the third toner cartridge TCC. The fourth toner memory TMK is configured to store therein fourth toner cartridge information related to the fourth toner cartridge TCK.

Each of the photosensitive drums 51 is rotatable about a first axis X1 extending in the axial direction. The axial direction crosses the first direction, and specifically, the axial direction is perpendicular to the first direction. The four photosensitive drums 51 are arranged in the first direction.

Each of the scorotron chargers 52 is a charger configured to charge the corresponding one of the photosensitive drums 51. Note that charge rollers may be employed in place of the scorotron chargers 52. Each of the cleaning rollers 53 is a roller configured to clean the surface of the corresponding photosensitive drum 51. Cleaning blades may be employed instead of the cleaning rollers 53.

The four developing units 60 are arranged in the first direction. Each of the developing units 60 is positioned between the corresponding toner cartridge TC and the corresponding photosensitive drum 51. Each of the developing units 60 includes the magnetic roller 61, a developing container 62, the first auger 63, a second auger 64, and a layer thickness regulation blade 65. The magnetic roller 61 is an example of a developing roller. The first auger 63 is an example of a conveying member.

Each of the magnetic rollers 61 is a roller configured to supply toner to the photosensitive drum 51. As illustrated in FIG. 2, the magnetic roller 61 includes a magnetic shaft 61A, and a magnetic sleeve 61B. The magnetic shaft 61A has alternating magnetic poles with a predetermined pattern in a circumferential direction thereof. The magnetic shaft 61A is a solid cylindrical member in which a plurality of permanent magnets are embedded, for example. The magnetic shaft 61A is fixed to the developing container 62.

The magnetic sleeve 61B is a hollow cylindrical member made of non-magnetic metal as main component, for example. The magnetic sleeve 61B is rotatable about the magnetic shaft 61A. The magnetic sleeve 61B holds carrier through a magnetic force of the magnetic shaft 61A. The toner and the carrier are triboelectric charged when agitated in the developing container 62, which enables the carrier to electrostatically hold the toner on the magnetic roller 61.

The magnetic roller 61 is positioned between the corresponding toner cartridge TC and the corresponding photosensitive drum 51. The magnetic sleeve 61B is rotatable about a second axis X2 extending in the axial direction. That is, the magnetic roller 61 is rotatable about the second axis X2 extending in the axial direction. The magnetic roller 61 faces the surface of the corresponding photosensitive drum 51 and is in separation from the same.

Each of the developing container 62 is a container configured to accommodate therein carrier which is magnetic material. The carrier is, for example, iron powder. The developing container 62 has an inlet 62A allowing the toner in the corresponding toner cartridge TC to be supplied to the developing container 62 therethrough. The inlet 62A is positioned on the opposite side of the first auger 63 and the second auger 64 from the magnetic roller 61.

The developing containers 62 include a first developing container 62Y to which the first toner cartridge TCY is attachable, a second developing container 62M to which the second toner cartridge TCM is attachable, a third developing container 62C to which the third toner cartridge TCC is attachable, and a fourth developing container 62K to which the fourth toner cartridge TCK is attachable.

Figure 4A:
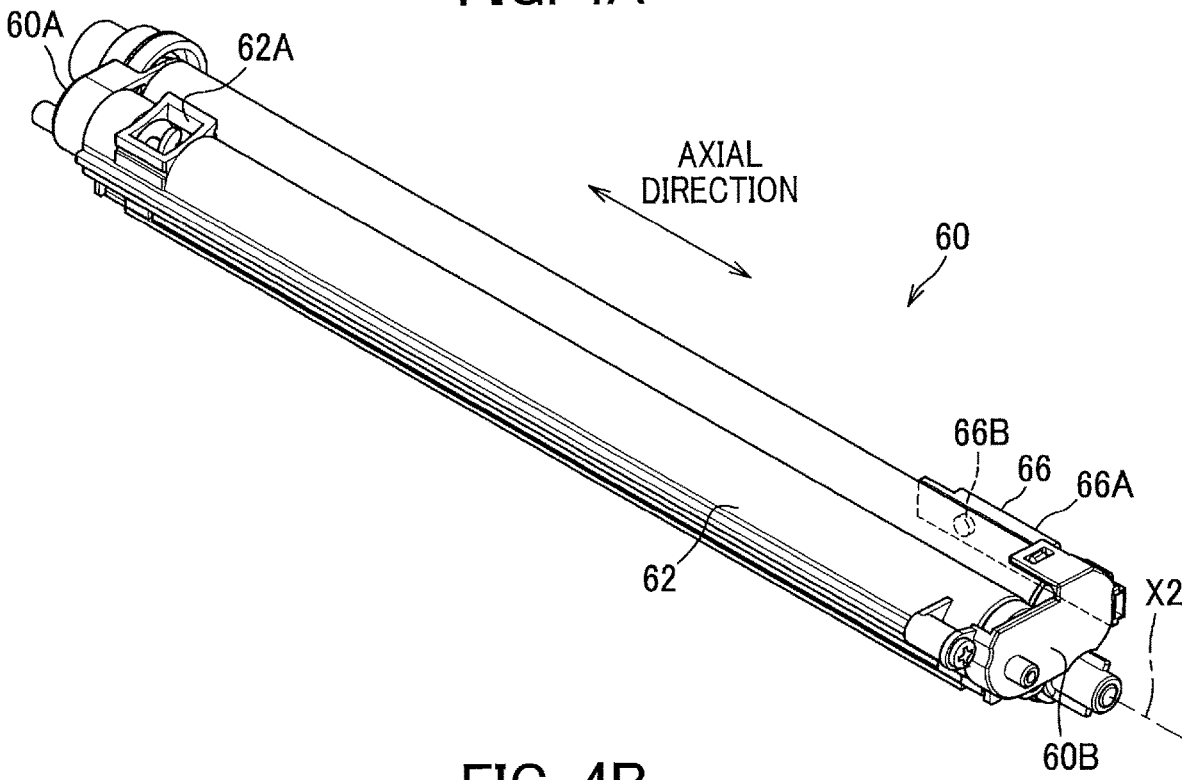
FIG. 4A is a perspective view of a developing unit.
Figure 4B:
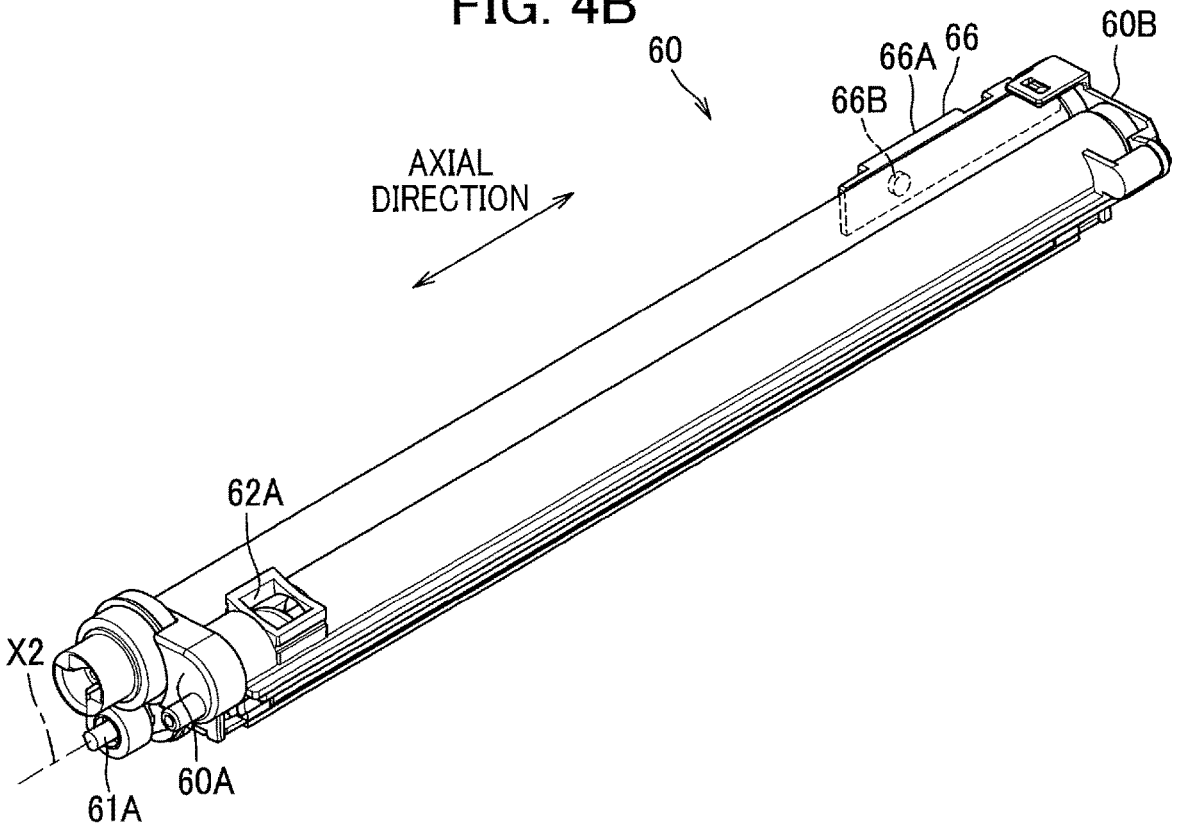
FIG. 4B is another perspective view of the developing unit.

The inlet 62A is positioned further upward than the first auger 63 and the second auger 64. Specifically, the inlet 62A is positioned vertically above the first auger 63. The second axis X2 is positioned further downward than the first auger 63 and the second auger 64. Specifically, the second axis X2 is positioned vertically below the second auger 64. Toner can be supplied to the developing container 62 through the inlet 62A upon attachment of the toner cartridge TC to the developing container 62. As illustrated in FIGS. 4A and 4B, the inlet 62A is positioned at one end portion in the axial direction of the developing container 62.

As illustrated in FIG. 2, the first auger 63 and the second auger 64 are positioned within the developing container 62. The first auger 63 is rotatable about a third axis X3 extending in the axial direction. The second auger 64 is rotatable about a fourth axis X4 extending in the axial direction. The first auger 63 and the second auger 64 are arranged in the first direction. The first auger 63 is positioned closer to the inlet 62A than the second auger 64 is to the inlet 62A.

The layer thickness regulation blade 65 is configured to regulate a thickness of a toner layer formed on the magnetic roller 61. The layer thickness regulation blade 65 is out of contact with the magnetic roller 61. The layer thickness regulation blade 65 is positioned further downward than the first auger 63 and the second auger 64. Specifically, the layer thickness regulation blade 65 is positioned vertically below the first auger 63.

The layer thickness regulation blade 65 is arranged with the magnetic roller 61 in the first direction. The second axis X2 is positioned between the layer thickness regulation blade 65 and the first axis X1 of the corresponding photosensitive drum 51 in the first direction.

The sheet guide 54 is a guide member configured to guide the sheet S toward the photosensitive drums 51. The sheet guide 54 is arranged with the photosensitive drums 51 in the first direction. The sheet guide 54 is positioned upstream of the four photosensitive drums 51 in a sheet conveying direction (i.e., a direction in which the sheet S is conveyed).

The magnetic roller 61 positioned at the most upstream side in the sheet conveying direction among the four magnetic rollers 61 is positioned between the sheet guide 54 and the second auger 64 corresponding to the most upstream magnetic roller 61. The layer thickness regulation blade 65 positioned at the most upstream side in the sheet conveying direction among the four layer thickness regulation blades 65 is positioned between the sheet guide 54 and the first auger 63 corresponding to the most upstream layer thickness regulation blade 65.

The connector 55 is positioned at an outer surface of the drum unit 50. Specifically, the connector 55 is positioned at the outer surface of the frame of the drum unit 50 supporting the developing units 60.

Referring back to FIG. 1, the transfer unit 70 is a member configured to transfer toner images on the photosensitive drums 51 to the sheet S. The transfer unit 70 is positioned between the sheet feeding unit 20 and the drum unit 50. The transfer unit 70 includes a driving roller 71, a driven roller 72, a conveyer belt 73, and transfer rollers 74.

The driving roller 71 and the driven roller 72 are spaced apart from each other in the first direction. The conveyer belt 73 is an endless belt looped over and supported by the driving roller 71 and the driven roller 72. The transfer rollers 74 are positioned in a space encircled by the conveyer belt 73. The conveyer belt 73 is nipped between the photosensitive drums 51 and the corresponding transfer rollers 74.

The fixing unit 80 includes a heat roller 81, and a pressure roller 82. The heat roller 81 and the pressure roller 82 are configured to nip the sheet S therebetween.

In the image forming unit 30, the scorotron chargers 52 charge the surfaces of the corresponding photosensitive drums 51. Thereafter, the scanner unit 40 irradiates the surfaces of the photosensitive drums 51 with laser beam, whereby electrostatic latent images are formed on the surfaces of the photosensitive drums 51.

The toner cartridges TC supply toners into the corresponding developing containers 62. In each of the developing units 60, the first auger 63 conveys toner and carrier in the developing container 62 to the second auger 64, and the second auger 64 supplies toner to the magnetic roller 61. The magnetic rollers 61 supply toners to electrostatic latent images formed on the surface of the corresponding photosensitive drum 51, whereby toner images are formed on the photosensitive drums 51.

The conveyer belt 73 conveys the sheet S so that the sheet S moves through a portion between the photosensitive drums 51 and the transfer rollers 74. At this time, the toner images formed on the photosensitive drums 51 are successively transferred onto the sheet S. Then, the sheet S passes through a portion between the heat roller 81 and the pressure roller 82, whereby the toner images transferred on the sheet S is thermally fixed to the sheet S.

The discharge unit 90 includes a plurality of discharge rollers 91 configured to discharge the sheet S out of the main body 10.

The controller 100 includes a CPU, a RAM, a ROM, and an input/output circuit. The controller 100 is configured to perform arithmetic processing on the basis of information on the attached cartridges and programs and data those stored in the ROM in order to control operations in the color printer 1.

As illustrated in FIG. 1, the connector 55 is electrically connected to the color printer 1 when the drum unit 50 is attached to the main body 10 of the color printer 1. Specifically, in a case where the drum unit 50 is attached to the main body 10, the connector 55 is in contact with the main connector 12 to establish electrical connection between the connector 55 and the main connector 12.

In a case where the connector 55 and the main connector 12 are electrically connected to each other in a state where the toner cartridges TC are attached to the frame of the drum unit 50, the controller 100 can read from the toner cartridge information from the toner memories TM and can write information to the toner memories TM.

As illustrated in FIGS. 4A and 4B, each of the developing units 60 further includes the toner sensor 66. Specifically, the toner sensors 66 include a first toner sensor 66Y capable of measuring a quantity of toner in the first developing container 62Y, a second toner sensor 66M capable of measuring a quantity of toner in the second developing container 62M, a third toner sensor 66C capable of measuring a quantity of toner in the third developing container 62C, and a fourth toner sensor 66K capable of measuring a quantity of toner in the fourth developing container 62K.

The toner sensor 66 is positioned at an end portion of the developing container 62 opposite the inlet 62A in the axial direction. Specifically, the toner sensor 66 is positioned at another end portion in the axial direction of the developing container 62. The other end portion is opposite the one end portion in the axial direction of the developing container 62 at which the inlet 62A is positioned.

Figure 5:
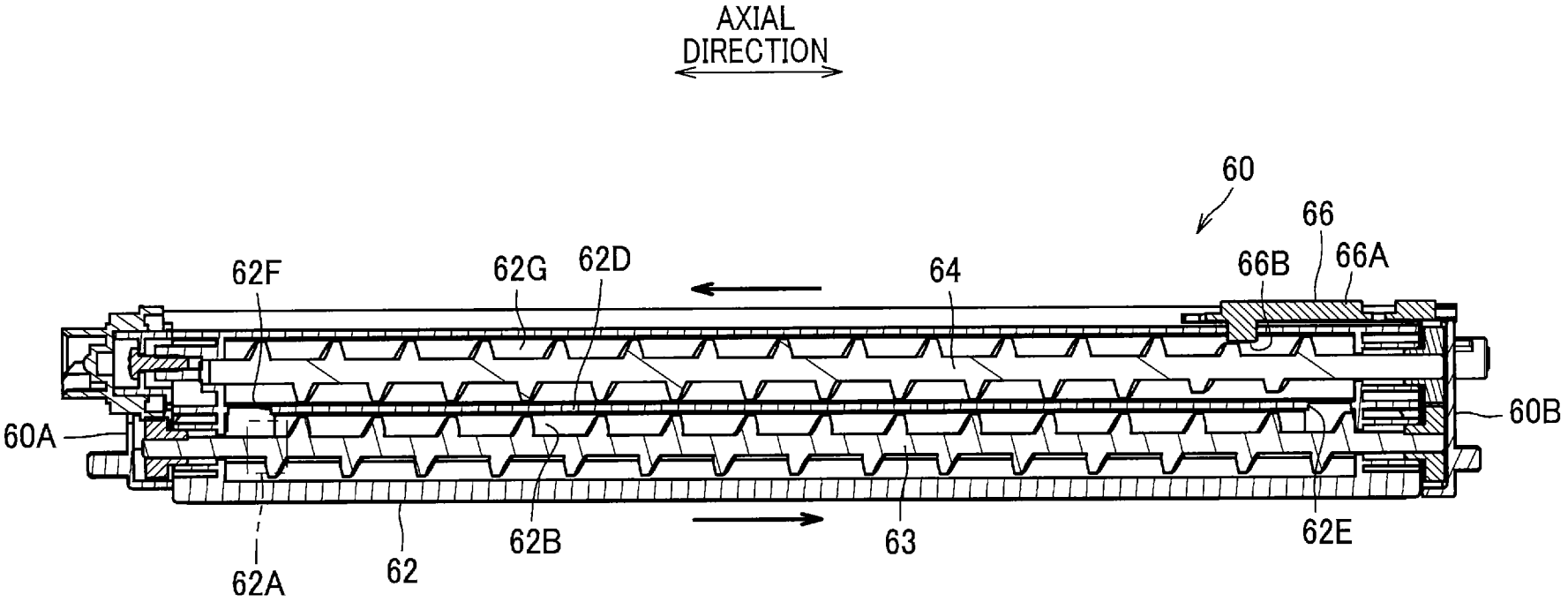
FIG. 5 is a cross-sectional view of the developing unit.

The toner sensor 66 is configured to measure a quantity of toner in the developing container 62. In the present embodiment, the toner sensor 66 is a magnetic sensor capable of measuring magnetic permeability. The toner sensor 66 includes a body part 66A, and a measure part 66B. As illustrated in FIG. 5, the body part 66A is positioned outside of the developing container 62. The measure part 66B is inserted through a hole formed at the developing container 62 so as to make contact with the toner and the carrier accommodated in the developing container 62. The measure part 66B has a disc shape.

The toner sensor 66 measures magnetic permeability using the measure part 66B and transmits a measurement signal to the controller 100 on the basis of the measured magnetic permeability. Accordingly, the controller 100 can determine the quantity of toner in the toner container 62 on the basis of the measurement signal transmitted from the toner sensor 66. In the present embodiment, the signal outputted from the toner sensor 66 is a voltage value. As the quantity of toner in the developing container 62 changes, a voltage value outputted from the toner sensor 66 also changes.

The developing container 62 includes a first accommodation chamber 62B, a second accommodation chamber 62G, and a partition wall 62D, and has a supply opening 62E, and a recovery opening 62F. The first accommodation chamber 62B defines therein an internal space in which the first auger 63 is accommodated. The second accommodation chamber 62G defines therein an internal space in which the second auger 64 is accommodated. Toner and carrier are accommodated in the first accommodation chamber 62B and the second accommodation chamber 62G.

The partition wall 62D is a wall partitioning the developing container 62 into the first accommodation chamber 62B and the second accommodation chamber 62G. The supply opening 62E is positioned at one end in the axial direction of the partition wall 62D. The first accommodation chamber 62B and the second accommodation chamber 62G are in communication with each other through the supply opening 62E. Accordingly, the supply opening 62E allows the toner and the carrier in the developing container 62 to be moved from the first accommodation chamber 62B to the second accommodation chamber 62G.

The recovery opening 62F is positioned at another end in the axial direction of the partition wall 62D. The first accommodation chamber 62B and the second accommodation chamber 62G are in communication with each other through the recovery opening 62F, whereby the supply opening 62E allows the toner and the carrier to be moved from the second accommodation chamber 62G to the first accommodation chamber 62B.

The inlet 62A is open to the first accommodation chamber 62B. A distance between the inlet 62A and the supply opening 62E is greater than a distance between the inlet 62A and the recovery opening 62F.

The first auger 63 is configured to convey the toner and the carrier in a direction directed from one end 60A toward another end 60B in the axial direction of the developing container 62. Specifically, the first auger 63 is configured to convey the toner supplied from the toner cartridge TC to the first accommodation chamber 62B through the inlet 62A and the carrier toward the supply opening 62E.

The second auger 64 is configured to convey the toner and the carrier in a direction from the other end 60B to the one end 60A in the axial direction of the developing container 62. Specifically, the second auger 64 is configured to convey the toner supplied to the second accommodation chamber 62G through the supply opening 62E toward the one end 60A.

The toner and the carrier conveyed in the axial direction by the second auger 64 is adhered to a surface of the magnetic roller 61 because of the magnetic force of the magnetic roller 61. The toner and the carrier conveyed toward the one end 60B of the developing container 62 is moved back to the first accommodation chamber 62B through the recovery opening 62F.

In this way, the first auger 63 and the second auger 64 convey the toner supplied through the inlet 62A and the carrier to the magnetic roller 61. Further, the first auger 63 and the second auger 64 perform circulation of the toner and the carrier in the developing container 62.

Figure 6:
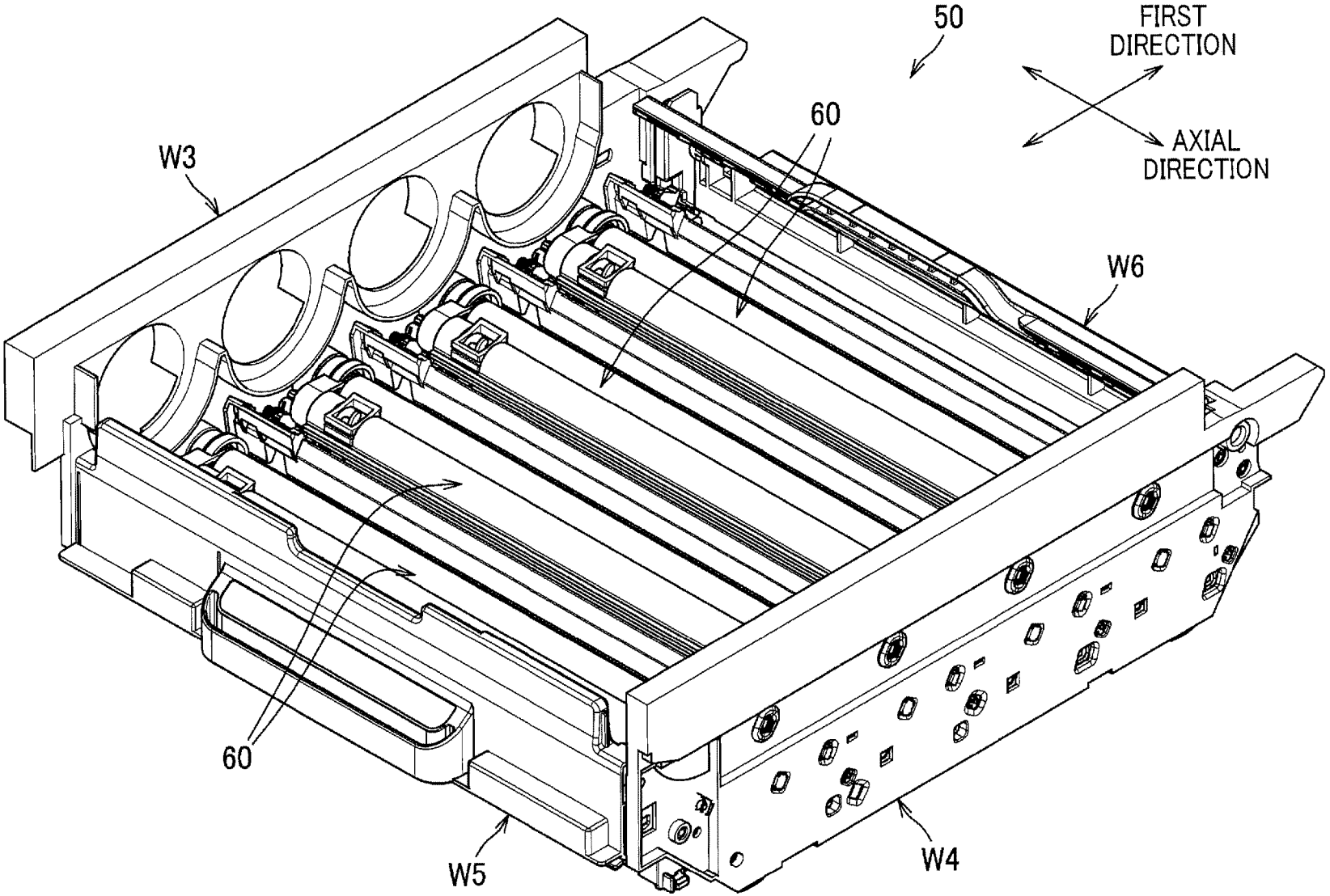
FIG. 6 is a perspective view of the drum unit.

As illustrated in FIG. 6, the drum unit 50 further includes a first side wall W3, a second side wall W4, a front wall W5, and a rear wall W6 those are made of resin, for example. These first side wall W3, second side wall W4, front wall W5, and rear wall W6 serves as an example of the frame supporting the photosensitive drums 51 and the developing units 60.

Each of the developing units 60 is positioned between the first side wall W3 and the second side wall W4 in the axial direction. The front wall W5 is positioned at one end portion in the first direction of the first side wall W3 and the second side wall W4. The rear wall W6 is positioned at another end portion in the first direction of the first side wall W3 and the second side wall W4.

When the drum unit 50 is attached to the main body 10, the controller 100 communicates with the toner sensors 66 in the drum unit 50, the toner memories TM, and a relay board memory 58M (described later). Hereinafter, electrical connections in the color printer 1 and the drum unit 50, and control executed by the controller 100 will be described with reference to FIGS. 7 through 9.

Figure 9:
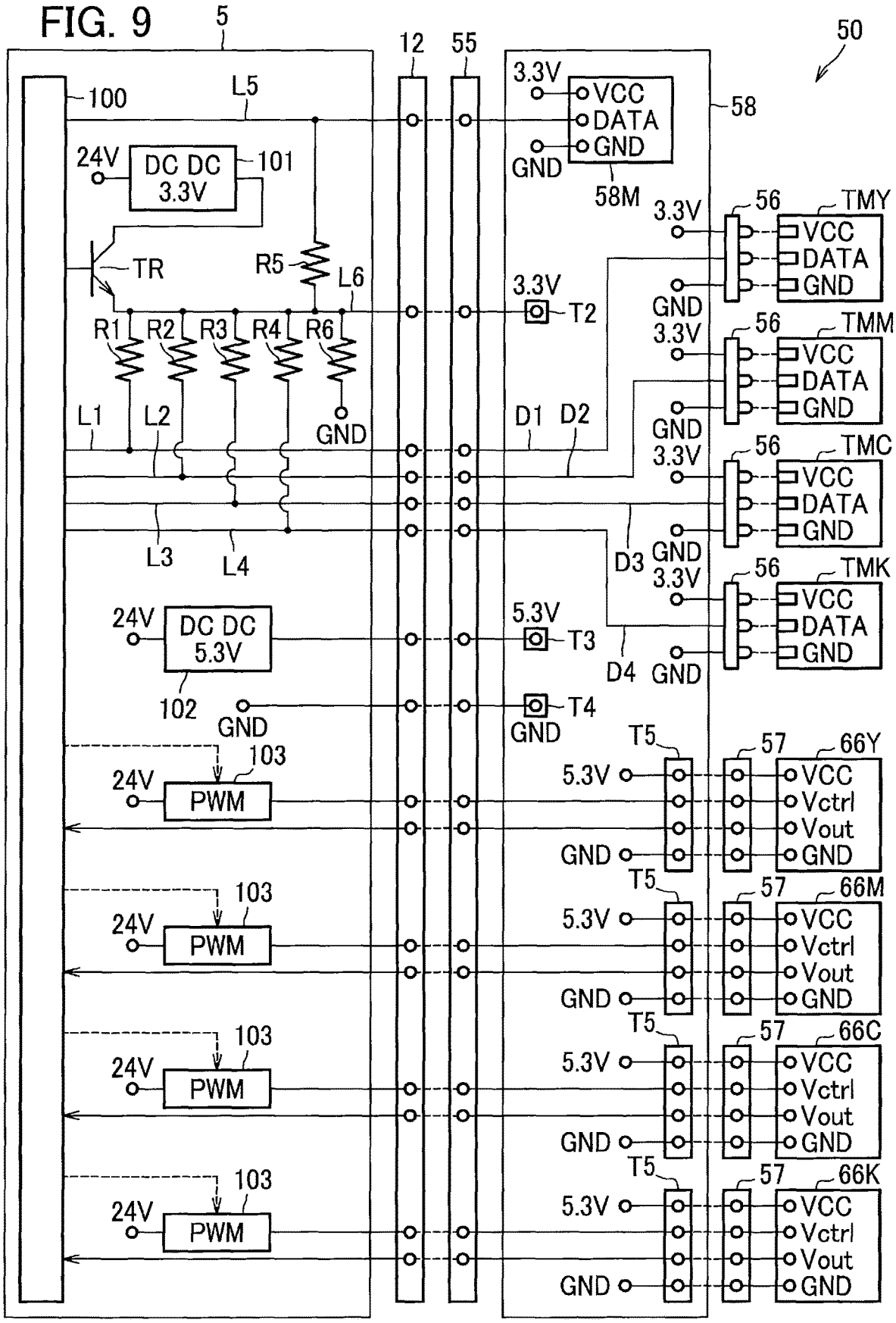
FIG. 9 is a circuit diagram for explaining connections among a main board, the relay board, toner memories, and the toner sensors.

As illustrated in FIG. 9, the color printer 1 further includes a main board 5. The main board 5 includes the controller 100 described above, a memory supply voltage generator 101, a sensor supply voltage generator 102, and a plurality of control voltage generators 103. In the present embodiment, the plurality of control voltage generators 103 are provided in one-to-one correspondence with the plurality of toner sensors 66.

The memory supply voltage generator 101 transforms an input voltage to generate a memory supply voltage, which is a voltage for operating the toner memories TM. In the present embodiment, the memory supply voltage generator 101 transforms a 24 V input voltage to 3.3 V.

The sensor supply voltage generator 102 transforms an input voltage to generate a sensor supply voltage, which is a voltage for operating the toner sensors 66. In the present embodiment, the sensor supply voltage generator 102 transforms a 24 V input voltage to 5.3 V.

Each of the control voltage generators 103 transforms an input voltage to generate a control voltage, which is a voltage for controlling measurement signals of the corresponding toner sensor 66. In the present embodiment, each of the control voltage generators 103 is controlled by the controller 100 to transform a 24 V input voltage, thereby generating a voltage suitable for the corresponding toner sensor 66. Note that "a voltage suitable for the corresponding toner sensor 66" in the present embodiment denotes a voltage that effects a larger change in a voltage value outputted from the toner sensor 66 when the quantity of toner in the developing container 62 changes.

Each of the control voltage generators 103 is, for example, a switching regulator, and converts an inputted DC voltage to a prescribed DC voltage by producing a pulse voltage through PWM control and smoothing the produced pulse voltage.

The main board 5 further includes a plurality of wires connecting the controller 100 and the main connector 12 to each other and configured to be electrically connected to data terminals of the toner memories TM. First to fourth pull-up resistors R1 to R4 are respectively connected to these wires. Specifically, the main board 5 further includes a first wire L1, a second wire L2, a third wire L3, a fourth wire L4, a fifth wire L5, and a sixth wire L6. The first wire L1, the second wire L2, the third wire L3, and the fourth wire L4 are examples of wires configured to be electrically connected to data terminals of toner memories.

The first wire L1 is a wire connecting the controller 100 and the main connector 12 to each other. When the main connector 12 and the connector 55 are connected to each other, data in the first toner memory TMY is transmitted to the controller 100 through the first wire L1. The first pull-up resistor R1 is connected to the first wire L1. The first pull-up resistor R1 electrically connects the first wire L1 and the sixth wire L6 to each other. The first pull-up resistor R1 is 1-10 kΩ, for example.

The second wire L2 is a wire connecting the controller 100 and the main connector 12 to each other. When the main connector 12 and the connector 55 are connected to each other, data in the second toner memory TMM is transmitted to the controller 100 through the second wire L2. The second pull-up resistor R2 is connected to the second wire L2. The second pull-up resistor R2 electrically connects the second wire L2 and the sixth wire L6 to each other. The second pull-up resistor R2 is 1-10 kΩ, for example.

The third wire L3 is a wire connecting the controller 100 and the main connector 12 to each other. When the main connector 12 and the connector 55 are connected to each other, data in the third toner memory TMC is transmitted to the controller 100 through the third wire L3. The third pull-up resistor R3 is connected to the third wire L3. The third pull-up resistor R3 electrically connects the third wire L3 and the sixth wire L6 to each other. The third pull-up resistor R3 is 1-10 kΩ, for example.

The fourth wire L4 is a wire connecting the controller 100 and the main connector 12 to each other. When the main connector 12 and the connector 55 are connected to each other, data in the fourth toner memory TMK is transmitted to the controller 100 through the fourth wire L4. The fourth pull-up resistor R4 is connected to the fourth wire L4. The fourth pull-up resistor R4 electrically connects the fourth wire L4 and the sixth wire L6 to each other. The fourth pull-up resistor R4 is 1-10 kΩ, for example.

The fifth wire L5 is a wire connecting the controller 100 and the main connector 12 to each other. When the main connector 12 and the connector 55 are connected to each other, data in the relay board memory 58M (described later) is transmitted to the controller 100 through the fifth wire L5.

A fifth pull-up resistor R5 is connected to the fifth wire L5. The fifth pull-up resistor R5 electrically connects the fifth wire L5 and the sixth wire L6 to each other. The fifth pull-up resistor R5 is 1-10 kΩ, for example.

The sixth wire L6 connects the memory supply voltage generator 101 and the main connector 12 to each other. When the main connector 12 and the connector 55 are connected to each other, a voltage transformed by the memory supply voltage generator 101 is supplied to the toner memories TM through the sixth wire L6.

A transistor TR capable of switching a power supply on and off is arranged on the sixth wire L6 between the memory supply voltage generator 101 and the main connector 12. In the present embodiment, the transistor TR turns the power supply on when the controller 100 is performing data communication, and turns the power supply off when the controller 100 is not performing data communication. The sixth wire L6 is grounded via a sixth resistor R6. The sixth resistor R6 is 1-10 kΩ, for example.

Figure 7:
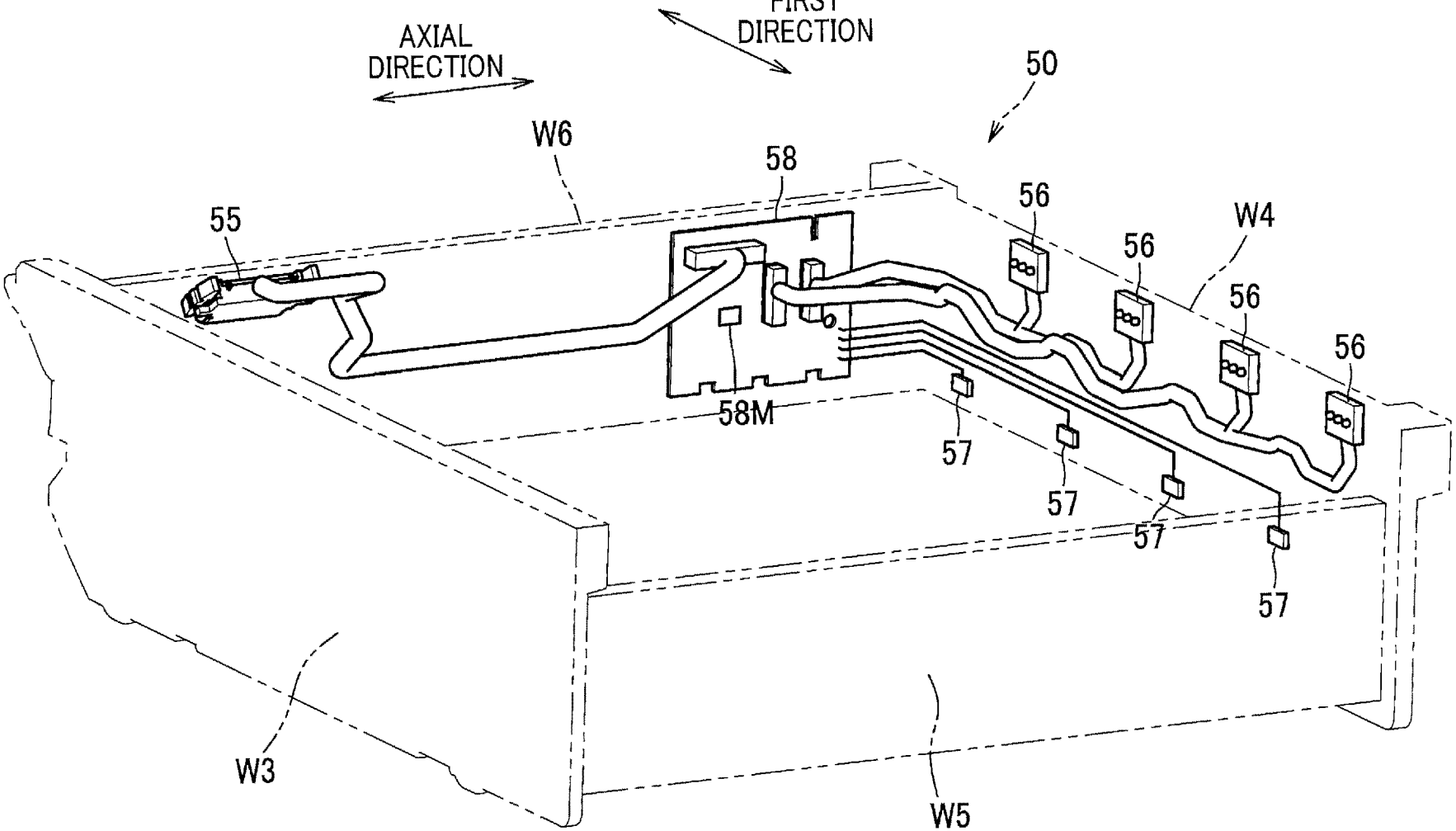
FIG. 7 is a perspective view illustrating wiring in the drum unit.
Figure 8:
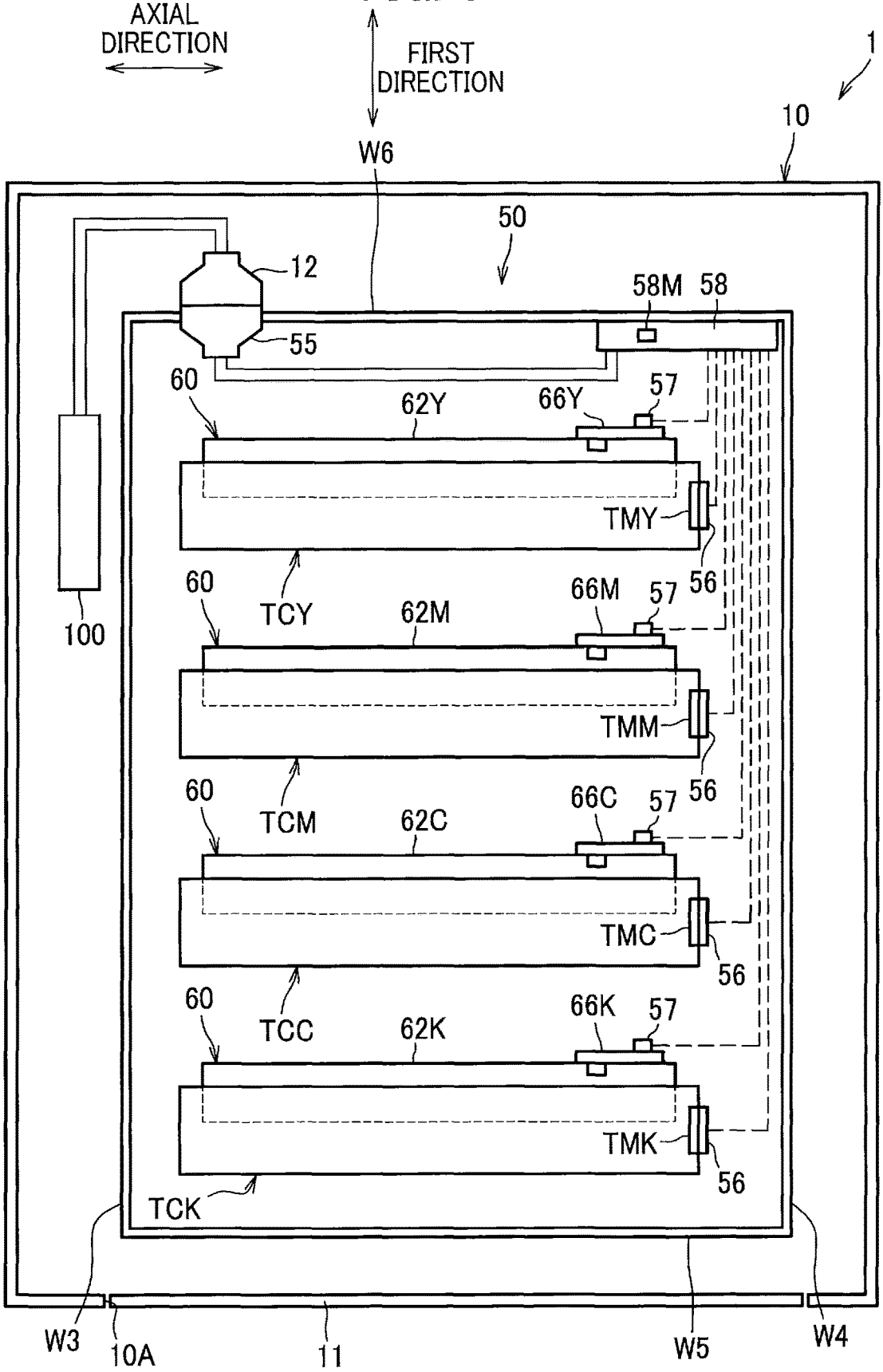
FIG. 8 is a top view of the color printer for explaining positional relationship among toner sensors, a relay board, a connector, and a controller.

As illustrated in FIG. 7, the drum unit 50 also includes a plurality of first electrical contact members 56 as examples of an electrical contact member, a plurality of second electrical contact members 57, and a relay board 58. The first electrical contact members 56 and the second electrical contact members 57 are electrically connected to the relay board 58 through wiring.

The relay board 58 is electrically connected to the connector 55 through wiring. As illustrated in FIG. 9, the relay board 58 electrically relays transmission of signals between three terminals of each of the toner memories TM and the connector 55. The relay board 58 communicates with the controller 100 to transmit information stored in the toner memories TM to the controller 100.

Each of the first electrical contact members 56 includes three electrical contacts. When the toner cartridges TC are attached to the drum unit 50, the three electrical contacts of each of the first electrical contact members 56 respectively contact the three terminals of the corresponding one of the toner memories TM.

Each of the toner memories TM includes only three terminals as electrical contacts, i.e., a power supply terminal (VCC) for supplying a supply voltage to the toner memory TM, a ground terminal (GND), and a data terminal (DATA) for communication of data to be written to the toner memory TM and data to be read from the toner memory TM.

Each of the toner memories TM is configured to perform communication according to a standard that sets a value of data based on a voltage for data communication at a timing when a prescribed period of time has elapsed since the voltage for data communication has made a prescribed change. The prescribed change of the voltage in data communication denotes a change in voltage from high to low or from low to high, for example.

As a specific example, when writing data to the toner memory TM, the controller 100 changes the voltage on the data line (the data signal) from high to low after starting data communication according to a prescribed communication protocol. The toner memory TM includes a circuit for setting a value of data as 0 or 1 based on a period of time required for the voltage to return to high after the controller 100 has changed the voltage on the data signal from high to low. For example, the circuit of the toner memory TM is configured to write "1" if the voltage is high and "0" if the voltage is low at a timing when a prescribed period of time has elapsed since the voltage on the data signal has changed from high to low.

The memory supply voltage is the voltage required for operating the toner memories TM. In the present embodiment, the memory supply voltage is 3.3 V.

Each of the second electrical contact members 57 includes four electrical contacts. The four electrical contacts of each of the second electrical contact members 57 respectively contact four electrical contacts of the corresponding one of the toner sensors 66. The four electrical contacts of each of the toner sensors 66 are an electrical contact for transmitting a sensor supply voltage (VCC), an electrical contact for transmitting a control voltage to the toner sensor 66 (Vctrl), an electrical contact for transmitting a measurement signal measured by the toner sensor 66 (Vout), and an electrical contact for grounding the toner sensor 66 (GND).

The sensor supply voltage is a voltage required to operate the toner sensor 66. In the present embodiment, the sensor supply voltage is 5.3 V. Further, the measurement signal measured by the toner sensor 66 is an analog signal.

As illustrated in FIG. 7, the drum unit 50 according to the present embodiment includes the plurality of (four) first electrical contact members 56 such that the first electrical contact members 56 are provided in one-to-one correspondence with the toner memories TM. The first electrical contact members 56 are positioned at an inner surface of the second side wall W4 to be arranged in the first direction. Each of the first electrical contact members 56 contacts the three terminals of the corresponding one of the toner memories TM and is thus electrically connected to the corresponding toner memory TM when the toner cartridges TC are attached to the drum unit 50 and the drum unit 50 is attached to the main body 10 (see FIG. 8).

The drum unit 50 includes the plurality of (four) second electrical contact members 57. The second electrical contact members 57 are provided in one-to-one correspondence with the plurality of toner sensors 66. The plurality of second electrical contact members 57 are positioned at the inner surface of the second side wall W4 and are arranged in the first direction. Each of the second electrical contact members 57 contacts the four electrical contacts of the corresponding one of the toner sensors 66 and is electrically connected to the corresponding toner sensor 66 as a result of attachment of the drum unit 50 to the main body 10.

The relay board 58 is positioned at an inner surface of the rear plate W6 of the drum unit 50. As illustrated in FIG. 9, the relay board 58 includes a memory supply voltage terminal T2, a sensor supply voltage terminal T3, a ground terminal T4, a plurality of sensor terminals T5, the relay board memory 58M as an example of a drum memory, a first data line D1, a second data line D2, a third data line D3, and a fourth data line D4.

The memory supply voltage terminal T2 is a terminal into which the controller 100 inputs the memory supply voltage. The memory supply voltage terminal T2 supplies the inputted memory supply voltage to the toner memories TM and the relay board memory 58M. In other words, the relay board 58 receives the inputted memory supply voltage, which is the voltage used to operate the toner memories TM, from the color printer 1 and outputs the memory supply voltage to the toner memories TM.

The sensor supply voltage terminal T3 is a terminal into which the controller 100 inputs the sensor supply voltage. The sensor supply voltage terminal T3 supplies this inputted sensor supply voltage to the toner sensors 66. In other words, the relay board 58 receives the inputted sensor supply voltage, which is the voltage used to operate the toner sensors 66, from the color printer 1 and outputs this sensor supply voltage to the toner sensors 66.

The ground terminal T4 is a terminal used for connecting a ground wire of the controller 100 and a ground wire of the relay board 58 to each other. The ground terminal T4 is connected to the ground terminals of the toner memories TM, the toner sensors 66, and the relay board memory 58M. In other words, the relay board 58 combines the ground wires of the toner memories TM, the toner sensors 66, and the relay board memory 58M into one.

Each of the sensor terminals T5 is a terminal for outputting measurement signals measured by the corresponding one of the toner sensors 66 to the controller 100. In other words, the relay board 58 electrically connects the toner sensors 66 and the connector 55 to each other and electrically relays transmission of measurement signals measured by the toner sensors 66 to the connector 55 to perform communication of the measurement signal to the controller 100 of the color printer 1. The plurality of sensor terminals T5 are provided in one-to-one correspondence with the plurality of toner sensors 66.

The relay board memory 58M has storage elements, and has storage areas for storing therein drum unit information related to the drum unit 50 and control voltage information for the toner sensors 66. In the present embodiment, control voltage information is stored in the storage areas of the relay board memory 58M for each of the toner sensors 66.

More specifically, first control voltage information for the first toner sensor 66Y, second control voltage information for the second toner sensor 66M, third control voltage information for the third toner sensor 66C, and fourth control voltage information for the fourth toner sensor 66K are stored in the relay board memory 58M.

The drum unit information is at least one of: identification information used to identify the drum unit 50; and drum lifetime information for the photosensitive drums 51. The identification information is, for example, a serial number. The drum unit information is, for example, at least one of: the cumulative number of rotations of the photosensitive drum 51; the cumulative number of sheets printed using the photosensitive drum 51; and the cumulative number of dot counts formed using the photosensitive drums 51.

The control voltage information is information used for generating a control voltage. For example, the control voltage information in the present disclosure is a voltage value for controlling the measurement signal of the toner sensor 66. The control voltages suitable for the respective toner sensors 66 are different from one another depending on the type of toner measured by the corresponding toner sensors 66, such as color of toner. The control voltages suitable for the respective toner sensors 66 are also different from one another according to product variation among the toner sensors 66.

Although there is a likelihood that the toner sensors 66 can perform measurement without the suitable control voltages, the quantity of toner in the developing container 62 can be measured more accurately with the suitable control voltages. In the present embodiment, the control voltage information is measured when the drum unit 50 is manufactured, and is stored in the relay board memory 58M in advance.

The relay board memory 58M includes three electrical contacts. These three electrical contacts are an electrical contact for transmitting a memory supply voltage (VCC), an electrical contact both for transmitting a synchronization signal to the relay board memory 58M and for transmitting data in the relay board memory 58M (DATA), and an electrical contact for grounding the relay board memory 58M (GND).

The first data line D1 connects the data terminal of the first toner memory TMY and the connector 55 to each other. The second data line D2 connects the data terminal of the second toner memory TMM and the connector 55 to each other. The third data line D3 connects the data terminal of the third toner memory TMC and the connector 55 to each other. The fourth data line D4 connects the data terminal of the fourth toner memory TMK and the connector 55 to each other.

The relay board 58 electrically relays data between the connector 55 and the toner memories TM to transmit information stored in the toner memories TM to the color printer 1. The relay board 58 also transmits the control voltage information stored in the relay board memory 58M to the color printer 1.

The controller 100 reads the control voltage information from the relay board memory 58M and controls the control voltage generators 103 to generate control voltages based on the read control voltage information. The controller 100 supplies the control voltages generated by the control voltage generators 103 to the toner sensors 66 via the relay board 58.

The controller 100 receives measurement signals measured by the toner sensors 66 and calculates the quantities of toners in the corresponding developing containers 62 based on the measurement signals.

The drum unit 50 according to the present embodiment described above can exhibit the following technical advantages.

A conventional toner memory for storing information related to a toner cartridge includes four or more terminals to be connected to a drum unit that is attachable to and detachable from a color printer. On the other hand, since each of the toner memories TM of the toner cartridges TC attachable to the drum unit 50 of the present embodiment includes only three terminals, the number of electrical contacts in the drum unit 50 can be reduced.

Specifically, the three terminals of each of the toner memories TM are a power supply terminal for supplying a supply voltage to the toner memory TM, a ground terminal, and a data terminal for transferring data to be written to the toner memory TM and data to be read from the toner memory TM.

Further, each of the toner memories TM performs communication according to a standard that sets a value of data based on a voltage for data communication at a timing when a prescribed period of time has elapsed since the voltage for data communication has made a prescribed change. Consequently, a terminal for communicating a synchronization signal (a clock signal) is not needed in the toner memories TM. Also, since each of the first electrical contact members 56 contacting the terminals of the corresponding toner memory TM needs only three electrical contacts, the wiring in the drum unit 50 can be reduced.

Further, the four toner memories TM are respectively connected to the controller 100 when the drum unit 50 is attached to the main body 10 of the color printer 1. Hence, the controller 100 can communicate with each of the toner memories TM independently. As a result, the controller 100 can communicate with all of the toner memories TM simultaneously, thereby reducing a period of time required for communicating with the toner memories TM in comparison with a case where the controller 100 communicates with the toner memories TM at different timings.

The color printer 1 includes wiring for connecting the controller 100 and the connector 55 to each other and configured to be electrically connected to the data terminals.

The first to fourth pull-up resistors R1, R2, R3, and R4 are respectively connected to the wires L1, L2, L3, and L4 that connect the controller 100 and the connector 55 to each other. Accordingly, the wires L1, L2, L3, and L4 can be maintained at a constant potential, thereby suppressing instabilities in potential.

The transistor TR can turn the power supply on when the controller 100 is performing communication and turn the power supply off when the controller 100 is not performing communication in order to conserve power consumed in the color printer 1. Further, turning the transistor TR off when the drum unit 50 is detached from the main body 10 can prevent detachment of the drum unit 50 while a voltage is still applied thereto.

<Second Embodiment>

Next, a second embodiment of the present disclosure will be described with reference to FIG. 10. Here, only parts and components different from those in the first embodiment will be described while a description of common parts will be omitted.

Although the drum unit 50 according to the first embodiment includes the plurality of data lines D1 to D4 respectively connecting the data terminals of the toner memories TM and the connector 55 to each other, a drum unit 150 according to the second embodiment includes a common data line D5 connecting all of the data terminals of the toner memories TM to the connector 55.

Figure 10:
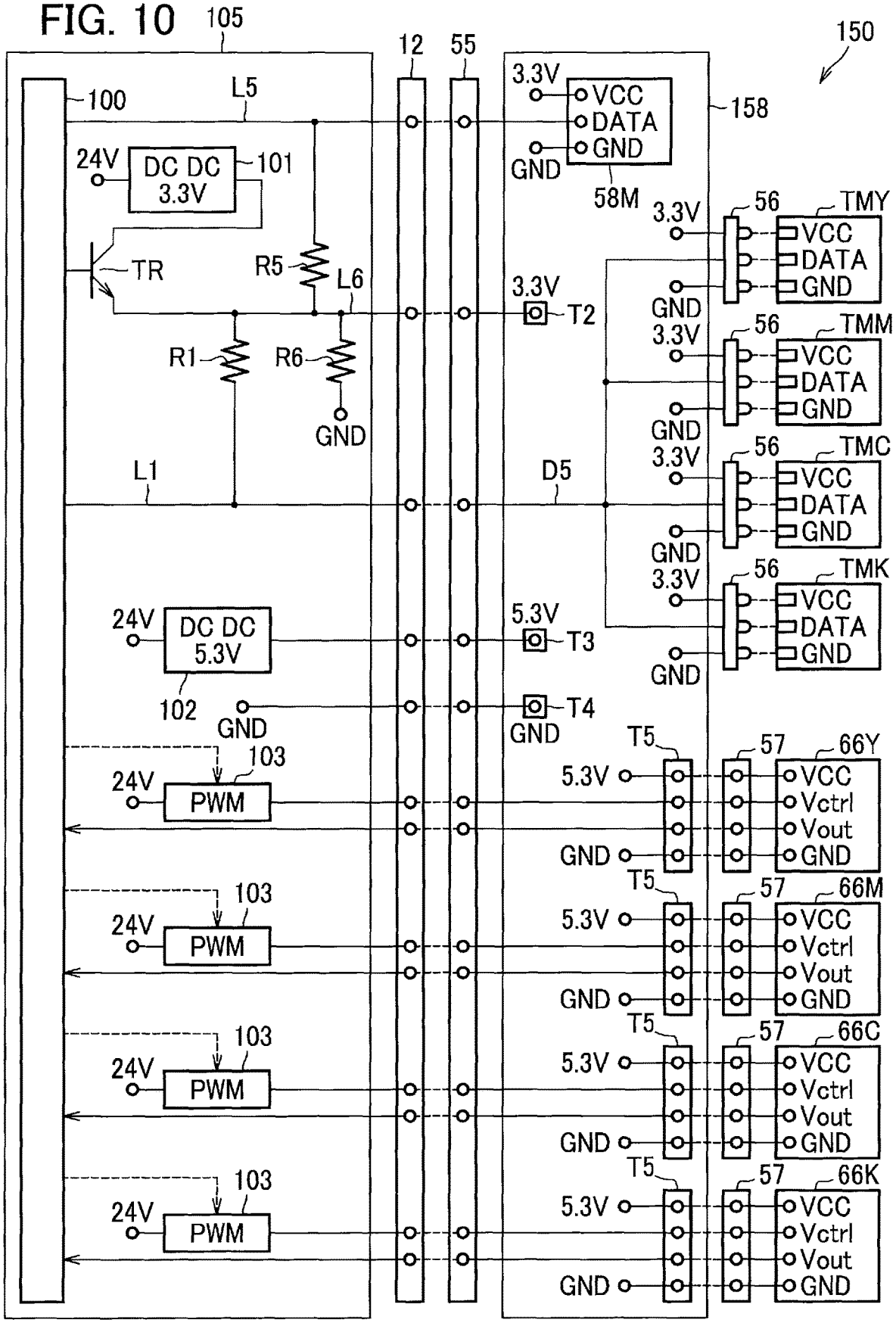
FIG. 10 is a circuit diagram for explaining connections among a main board, a relay board, the toner memories, and the toner sensors.

Specifically, the drum unit 150 according to the second embodiment includes a relay board 158, as illustrated in FIG. 10. The relay board 158 includes the common data line D5 for connecting the data terminals of the first toner memory TMY, the second toner memory TMM, the third toner memory TMC, and the fourth toner memory TMK to the connector 55. That is, the common data line D5 connects the connector 55 to all of the four data terminals.

In the second embodiment, a main board 105 includes a single wire L1 for transferring data from each of the toner memories TM. The wire L1 connects the controller 100 and the connector 55 to each other and is configured to be electrically connected to the data terminals of the toner memories TM. The pull-up resistor R1 is connected to the wire L1. In order to identify one of the toner memories TM as the communication counterpart in the second embodiment, the controller 100 transmits data signal including a signal for identifying the corresponding toner memory TM when communicating with the toner memories TM.

Since the drum unit 150 according to the second embodiment includes the common data line D5, the drum unit 150 requires even less wiring than the drum unit 50 described in the first embodiment. Further, the main board 105 includes only the single wire L1 for transferring data from each of the toner memories TM, thereby also reducing wiring in the main board 105.

<Third Embodiment>

Next, a third embodiment of the present disclosure will be described with reference to FIG. 11. Here, only parts and components different from those in the first embodiment will be described, while a description of the common parts will be omitted.

While the drum unit 50 according to the first embodiment includes the plurality of data lines D1 to D4 respectively connecting the data terminals in the plurality of toner memories TM and the connector 55 to each other, a drum unit 250 according to the third embodiment includes a relay board 258 that includes a multiplexer.

Figure 11:
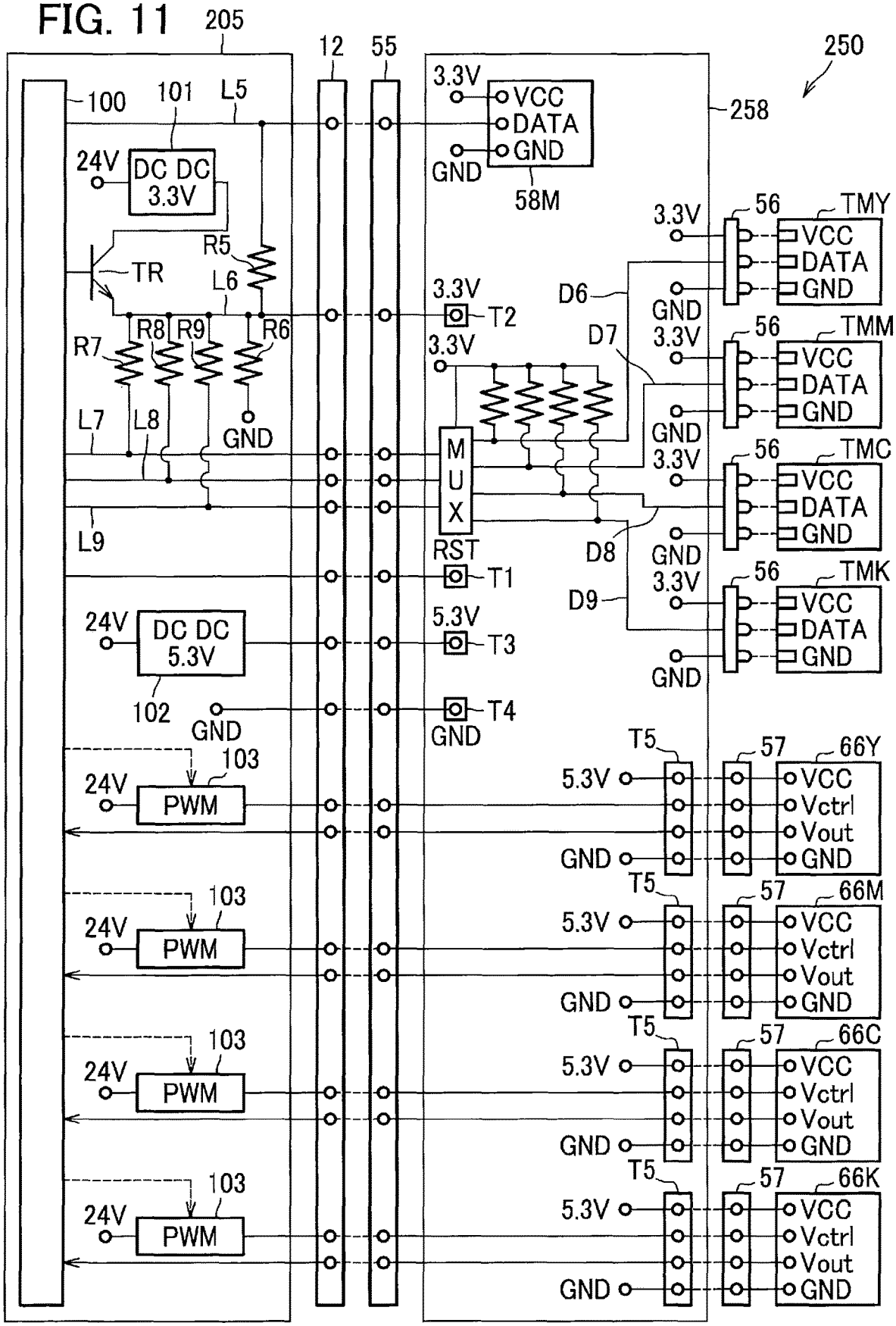
FIG. 11 is a circuit diagram for explaining connections among a main board, a relay board, the toner memories, and the toner sensors.

Specifically, as illustrated in FIG. 11, the relay board 258 of the drum unit 250 includes a multiplexer MUX, and a reset terminal T1. The multiplexer MUX is capable of selectively connecting the data terminal in one of the first toner memory TMY, the second toner memory TMM, the third toner memory TMC, and the fourth toner memory TMK to the connector 55. In accordance with commands from the controller 100, the multiplexer MUX can select any of the toner memories TM to communicate with the controller 100. The reset terminal T1 is a terminal used to transfer a reset signal between the controller 100 and the relay board 258.

The drum unit 250 further includes a data line D6 connecting the data terminal of the first toner memory TMY and the multiplexer MUX to each other, a data line D7 connecting the data terminal of the second toner memory TMM and the multiplexer MUX to each other, a data line D8 connecting the data terminal of the third toner memory TMC and the multiplexer MUX to each other, and a data line D9 connecting the data terminal of the fourth toner memory TMK and the multiplexer MUX to each other.

Pull-up resistors are connected to the data lines D6, D7, D8, and D9, respectively. Here, the pull-up resistors electrically connect a power supply terminal (3.3 V) to the respective data lines D6, D7, D8, and D9.

Further, in the third embodiment, a main board 205 includes two MUX switching signal lines L7 and L8 for transmitting switching signals to switch the multiplexer MUX, and a wire L9 connecting the controller 100 and the connector 55 to each other to enable data-communication between the controller 100 and the multiplexer MUX. Pull-up resistors R7, R8, and R9 are respectively connected to the MUX switching signal lines L7 and L8 and the wire L9.

The controller 100 switches the communication destination according to the combination of high and low signals in the two MUX switching signal lines L7 and L8. For example, the controller 100 switches connections so that the multiplexer MUX communicates with the first toner memory TMY when L7=high and L8=high, communicates with the second toner memory TMM when L7=high and L8=low, communicates with the third toner memory TMC when L7=low and L8=high, and communicates with the fourth toner memory TMK when L7=low and L8=low.

By providing the drum unit 250 of the third embodiment with the multiplexer MUX, the wiring in the drum unit 250 can be further reduced than the drum unit 50 in the first embodiment. Wiring in the main board 205 for communicating data of the toner memories TM can also be reduced.

Further, pull-up resistors are connected to each of the data lines D6, D7, D8, and D9, which can suppress instability in potential of data lines not selected by the multiplexer MUX.

<Fourth Embodiment>

Next, a fourth embodiment of the present disclosure will be described with reference to FIG. 12. Here, only parts and components different from those in the first embodiment will be described, while a description of the common parts will be omitted.

Each of the toner memories TMY, TMM, TMC, and TMK in the first embodiment includes only three terminals for use as electrical contacts. To the contrary, each of the toner memories in a drum unit 350 according to the fourth embodiment includes only two terminals for use as electrical contacts.

Figure 12:
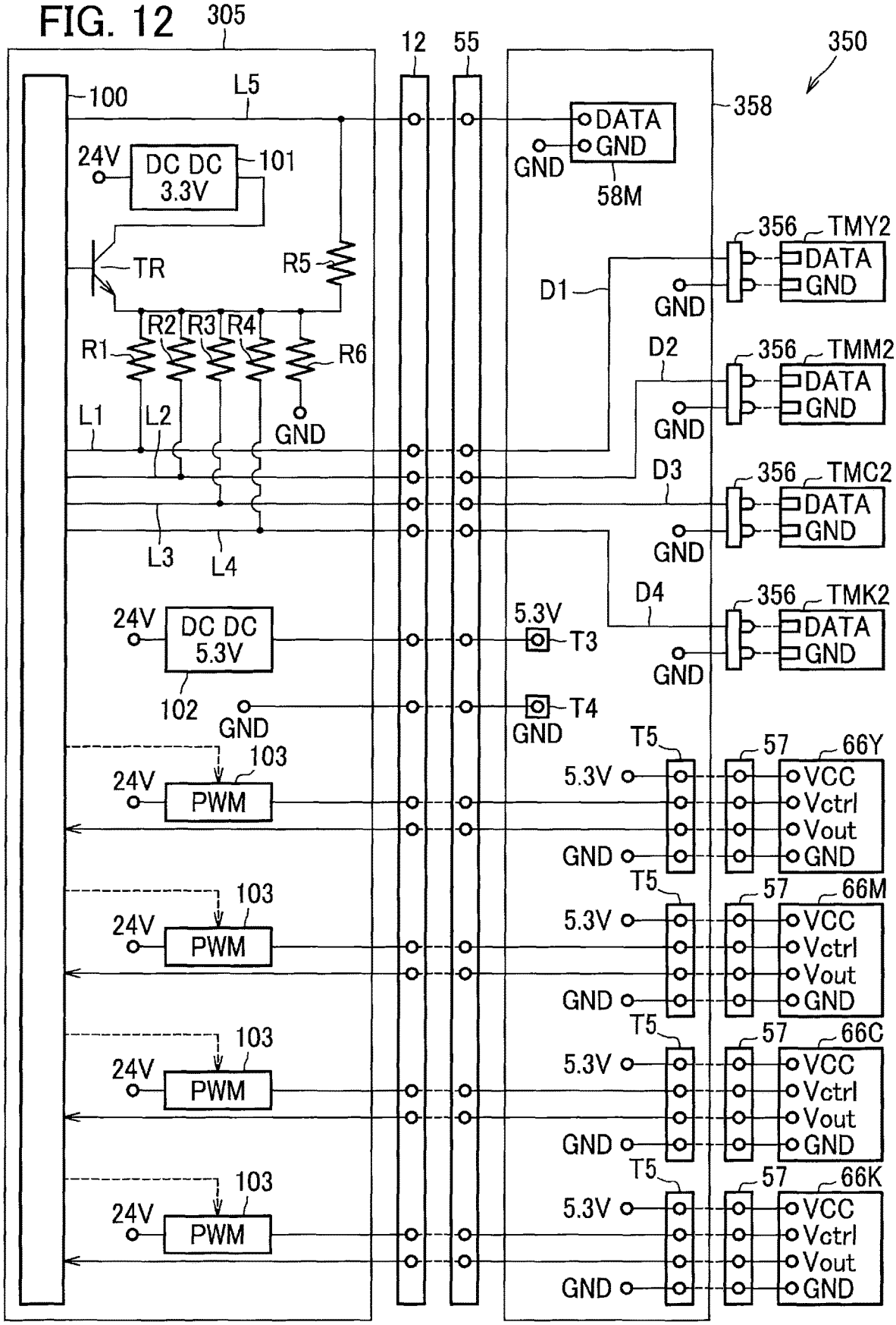
FIG. 12 is a circuit diagram for explaining connections among a main board, a relay board, toner memories, and the toner sensors.

Specifically, the drum unit 350 according to the fourth embodiment includes first to fourth toner memories TMY2, TMM2, TMC2, and TMK2 instead of toner memories TMY, TMM, TMC, and TMK, as illustrated in FIG. 12. Each of the toner memories TMY2, TMM2, TMC2, and TMK2 in the fourth embodiment includes only two terminals as electrical contacts, i.e., a ground terminal (GND), and a data terminal (DATA) for providing a supply voltage to the toner memory TM and for transferring data to be written to the toner memory TM and data to be read from the toner memory TM.

As in the first embodiment, each of the toner memories TM is configured to perform communication according to a standard that sets a value of data based on a voltage for data communication at a timing when a prescribed period of time has elapsed since the voltage for data communication has changed by a prescribed quantity.

The drum unit 350 further includes a plurality of first electrical contact members 356 each of which includes two electrical contacts. The two electrical contacts of each of the first electrical contact members 356 contact the two terminals in the corresponding toner memory TM when the toner cartridges TC are attached to the drum unit 350.

The drum unit 350 also includes a relay board 358. The relay board 358 includes a plurality of data lines D1 to D4 respectively connecting the data terminals of the corresponding toner memories TMY2, TMM2, TMC2, and TMK2 and the connector 55 to each other.

The first data line D1 connects the data terminal of the first toner memory TMY2 and the connector 55 to each other. The second data line D2 connects the data terminal of the second toner memory TMM2 and the connector 55 to each other. The third data line D3 connects the data terminal of the third toner memory TMC2 and the connector 55 to each other. The fourth data line D4 connects the data terminal of the fourth toner memory TMK2 and the connector 55 to each other.

In the present embodiment, a single terminal is used to supply voltage and to transfer data. Specifically, the data line signals are branched in the circuitry of the toner memory TM in order to supply a power supply voltage and to transfer data. The power supply voltage can be generated by smoothing the branched data signals.

Since each of the toner memories TM includes only two terminals in the drum unit 350 according to the fourth embodiment, the number of electrical contacts can be reduced.

<Fifth Embodiment>

Figure 13:
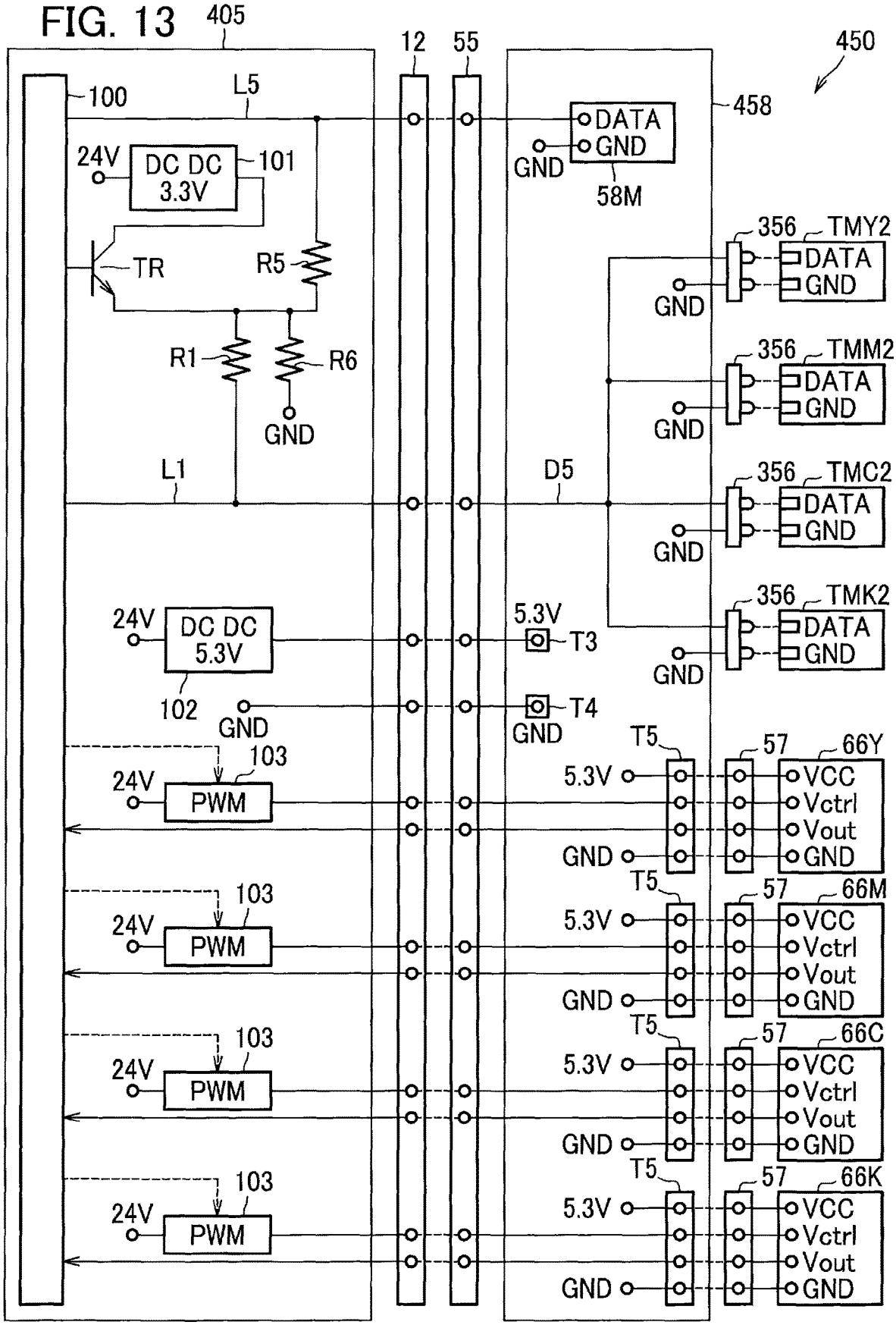
FIG. 13 is a circuit diagram for explaining connections among a main board, a relay board, the toner memories, and the toner sensors.

Next, a fifth embodiment of the present disclosure will be described with reference to FIG. 13. Here, only parts and components different from those in the fourth embodiment will be described, while a description of the common parts will be omitted.

Although the relay board 358 in the fourth embodiment includes the plurality of data lines D1 to D4 respectively connecting the data terminals of the toner memories TMY2, TMM2, TMC2, and TMK2 and the connector 55 to each other, a drum unit 450 according to the fifth embodiment includes a relay board 458 that includes a common data line D5 described in the second embodiment. The common data line D5 connects all of the data terminals of the toner memories TMY2, TMM2, TMC2, and TMK2 to the connector 55.

By providing the common data line D5 in the drum unit 450 of the fifth embodiment, the drum unit 450 requires even less wiring than the drum unit 350 described in the fourth embodiment.

<Sixth Embodiment>

Figure 14:
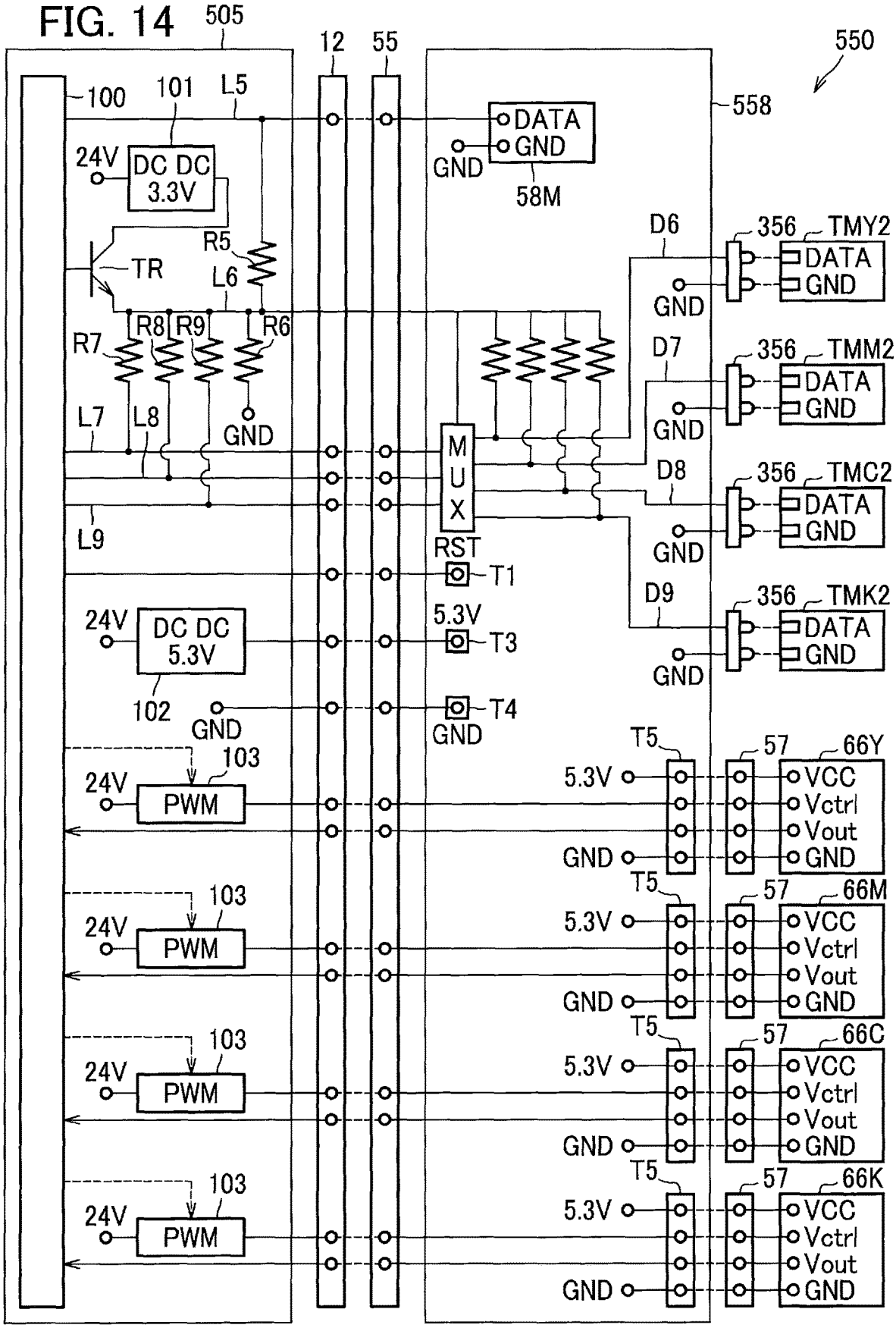
FIG. 14 is a circuit diagram for explaining connections among a main board, a relay board, the toner memories, and the toner sensors.

Next, a sixth embodiment of the present disclosure will be described with reference to FIG. 14. Here, only parts and components different from those in the fourth embodiment will be described, while a description of the common parts will be omitted.

While the relay board 358 according to the fourth embodiment includes the plurality of data lines D1 to D4 connecting the data terminals in the respective toner memories TMY2, TMM2, TMC2, and TMK2 to the connector 55, a drum unit 550 according to the sixth embodiment includes a relay board 558 including a multiplexer MUX. The multiplexer MUX in the sixth embodiment has a configuration identical to that described in the third embodiment and, hence, a description will not be repeated here.

By providing the multiplexer MUX in the drum unit 550 according to the sixth embodiment, wiring in the drum unit 550 can be further reduced from the drum unit 350 described in the fourth embodiment.

<Modifications>

While the description has been made in detail with reference to the embodiments, it would be apparent to those skilled in the art that the present disclosure not limited to the embodiments and various changes and modifications may be made to the specific configuration in the embodiments.

By the toner memories TM performing communication according to a standard that sets a value of data based on a voltage for data communication at a timing when a prescribed period of time has elapsed since the voltage for data communication has made a prescribed change, the configuration in the first embodiment described above does not require a synchronization signal (a clock signal). However, the color printer 1 may be configured so that power can be supplied and a synchronization signal can be transmitted using a single terminal.

As an example, each of the toner memories may include only three terminals serving as electrical contacts, i.e., a power supply terminal for both supplying a supply voltage to the toner memory and transmitting a synchronization signal, a ground terminal, and a data terminal for communication of data. Since the toner memory in this configuration includes only three terminals, as described in the first embodiment, the number of electrical contacts in a drum unit that is attachable to and detachable from the color printer 1 can be reduced.

The drum unit in the embodiments described above uses so-called two-component toner. That is, the drum unit includes a developing roller, a developing container accommodating therein carrier, and a conveying member positioned within the developing container and capable of conveying both toner and carrier toward the developing roller. However, another configuration may be employed in the drum unit. For example, a nonmagnetic single-component toner may be used.

Figure 15:
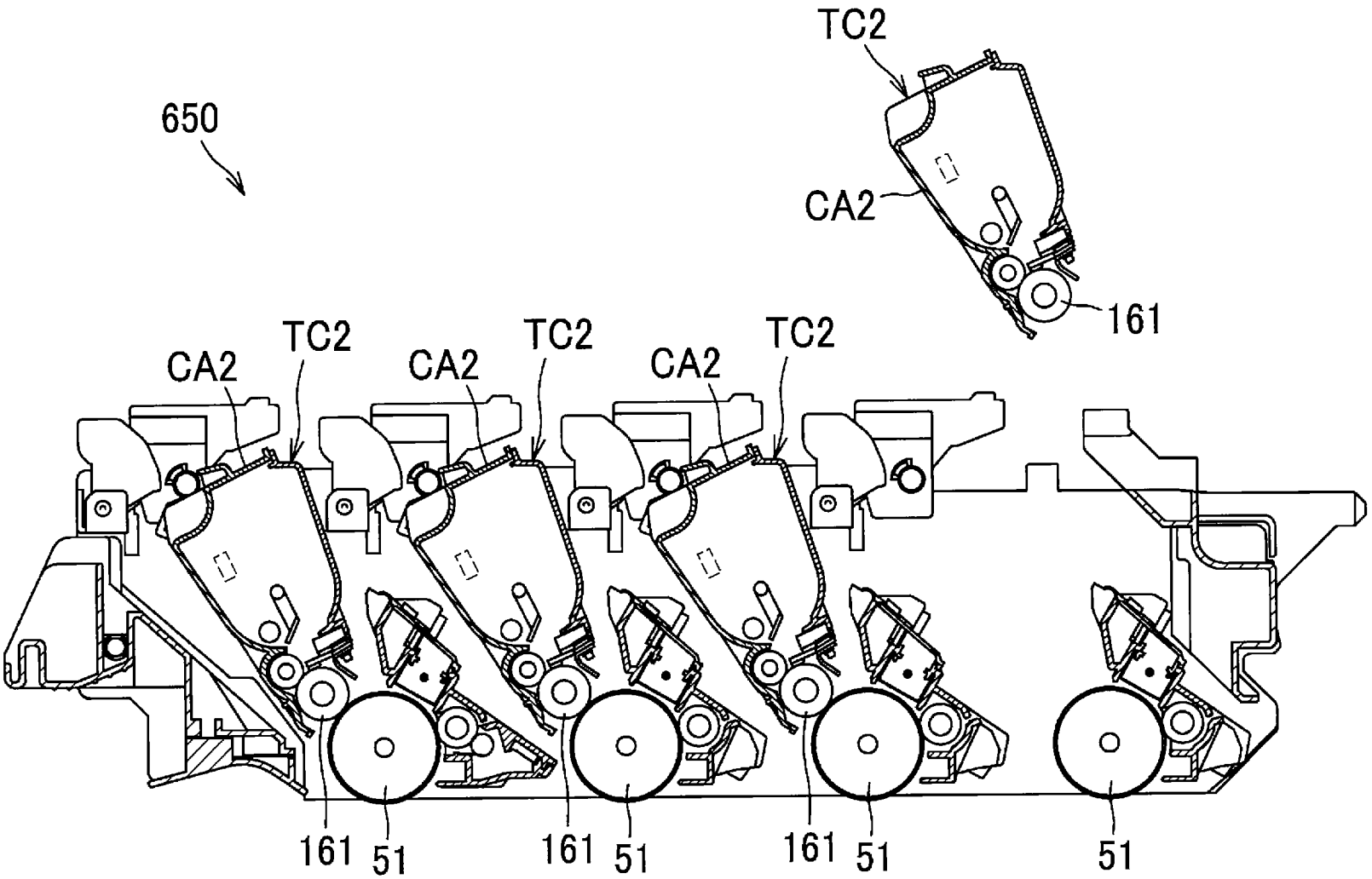
FIG. 15 is a cross-sectional view illustrating a drum unit.

FIG. 15 illustrates a drum unit 650 according to a modification to the embodiments. The drum unit 650 includes a plurality of toner cartridges TC2. Each of the toner cartridges TC2 includes a toner casing CA2 that accommodates toner therein, and a developing roller 161 for supplying toner in the toner casing CA2 to the corresponding photosensitive drum 51. In other words, toner cartridges TC2 for nonmagnetic single-component toner are attachable to and detachable from a frame of the drum unit 650 in this modification. Thus, the present disclosure can be applied to the drum unit 650 employing single-component toner, as well as the drum units employing two-component toner in the above embodiments.

In the embodiments described above, both of the drum unit information and the control voltage information are stored in a single relay board memory. However, the drum unit may include a plurality of relay board memories, and the drum unit information and the control voltage information may be stored in separate memories.

Although the drum unit of the present disclosure is applied to the color printer 1 in the embodiments described above, the present disclosure may be applied to an image forming apparatus other than the color printer 1, such as a copying machine or a multifunction peripheral.

In the embodiments described above, the pull-up resistors are respectively connected to the wires connecting the controller 100 and the connector 55 to each other, but the present disclosure is not limited to this configuration. For example, pull-down resistors may be respectively connected to the wires instead.

In the third and sixth embodiments described above, the pull-up resistors are respectively connected to the data lines connecting the data terminals of the toner memories and the multiplexer to each other, but the present disclosure is not limited to this configuration. For example, pull-down resistors may be connected to the data lines instead.

In the embodiments described above, the main board includes a transistor positioned between the memory supply voltage generator and the main connector. However, supply of power may be controlled using another configuration such as a DC-to-DC converter, an LDO regulator, or another power supply regulator circuit.

The elements appearing in the embodiments and modifications described above may be implemented in any arbitrary combination.

What is claimed is:

1. A drum unit attachable to and detachable from an image forming apparatus, the drum unit comprising:

a frame;

a photosensitive drum;

a toner cartridge attachable to and detachable from the frame of the drum unit, the toner cartridge comprising:

a toner casing configured to accommodate toner therein; and a toner memory configured to store therein information related to the toner cartridge, the toner memory consisting of three terminals as electrical contacts, the three terminals being a power supply terminal for supplying a supply voltage to the toner memory, a ground terminal, and a data terminal for communication of data to be written into the toner memory and data to be read from the toner memory, the toner memory being configured to perform communication according to a standard that sets a value of data on a basis of a voltage for data communication at a timing when a prescribed period of time has elapsed since the voltage for data communication has made a prescribed change;

a connector electrically connected to the image forming apparatus when the drum unit is attached to the image forming apparatus; and a relay board electrically relaying the three terminals of the toner memory and the connector to transmit information stored in the toner memory to the image forming apparatus when the toner cartridge is attached to the frame of the drum unit.

2. The drum unit according to claim 1, further comprising an electrical contact member including three electrical contacts respectively making contact with the power supply terminal, the ground terminal, and the data terminal when the toner cartridge is attached to the frame of the drum unit, wherein the electrical contact member is electrically connected to the connector through the relay board.

3. The drum unit according to claim 1, wherein the relay board includes a drum memory configured to store therein information related to the photosensitive drum.

4. The drum unit according to claim 1, further comprising:

a developing roller configured to supply toner in the toner casing to the photosensitive drum;

a developing container configured to accommodate therein carrier;

a conveying member positioned within the developing container and capable of conveying toner and carrier toward the developing roller; and a toner sensor capable of measuring a quantity of toner in the developing container, wherein the relay board electrically relays signal outputted from the toner sensor.

5. The drum unit according to claim 1, wherein the toner cartridge includes a developing roller configured to supply toner in the toner casing to the photosensitive drum.

6. The drum unit according to claim 1, wherein the toner memory includes a first toner memory and a second toner memory, wherein the toner cartridge includes a first toner cartridge including the first toner memory and a second toner cartridge including the second toner memory, and wherein the relay board includes:

a first data line connecting a data terminal of the first toner memory and the connector to each other; and a second data line connecting a data terminal of the second toner memory and the connector to each other.

7. The drum unit according to claim 1, wherein the toner memory includes a first toner memory and a second toner memory, wherein the toner cartridge includes a first toner cartridge including the first toner memory and a second toner cartridge including the second toner memory, and wherein the relay board includes a common data line connecting a data terminal of the first toner memory and a data terminal of the second toner memory to the connector.

8. The drum unit according to claim 1, wherein the toner memory includes a first toner memory and a second toner memory, wherein the toner cartridge includes a first toner cartridge including the first toner memory and a second toner cartridge including the second toner memory, and wherein the relay board includes a multiplexer capable of selectively connecting one of a data terminal of the first toner memory and a data terminal of the second toner memory to connector.

9. The drum unit according to claim 8, further comprising:

a data line connecting the data terminal of the first toner memory and the multiplexer to each other, a pull-up resistor being connected to the data line; and another data line connecting the data terminal of the second toner memory and the multiplexer to each other, another pull-up resistor being connected to the another data line.

10. An image forming apparatus to which the drum unit according to claim 1 is attachable, the image forming apparatus comprising:

a controller; and a wire connecting the controller and the connector to each other and configured to be electrically connected to the data terminal, wherein a pull-up resistor is connected to the wire.

11. A drum unit attachable to and detachable from an image forming apparatus, the drum unit comprising:

a frame;

a photosensitive drum;

a toner cartridge attachable to and detachable from the frame of the drum unit, the toner cartridge comprising:

a toner casing configured to accommodate toner therein; and a toner memory configured to store therein information related to the toner cartridge, the toner memory consisting of three terminals as electrical contacts, the three terminals being a power supply terminal for supplying a supply voltage to the toner memory and for communicating a synchronization signal, a ground terminal, and a data terminal for communication of data;

a connector electrically connected to the image forming apparatus when the drum unit is attached to the image forming apparatus; and a relay board electrically relaying the three terminals of the toner memory and the connector to transmit information stored in the toner memory to the image forming apparatus when the toner cartridge is attached to the frame of the drum unit.

12. A drum unit attachable to and detachable from an image forming apparatus, the drum unit comprising:

a frame;

a photosensitive drum;

a toner cartridge attachable to and detachable from the frame of the drum unit, the toner cartridge comprising:

a toner casing configured to accommodate toner therein; and a toner memory configured to store therein information related to the toner cartridge, the toner memory consisting of two terminals as electrical contacts, the two terminals being a ground terminal, and a data terminal for supplying a supply voltage to the toner memory and for communication of data to be written into the toner memory and data to be read from the toner memory, the toner memory being configured to perform communication according to a standard that sets a value of data on a basis of a voltage for data communication at a timing when a prescribed period of time has elapsed since the voltage for data communication has made a prescribed change;

a connector electrically connected to the image forming apparatus when the drum unit is attached to the image forming apparatus; and a relay board electrically relaying the two terminals of the toner memory and the connector to transmit information stored in the toner memory to the image forming apparatus when the toner cartridge is attached to the frame of the drum unit.

13. The drum unit according to claim 12, further comprising an electrical contact member including two electrical contacts respectively making contact with the ground terminal and the data terminal when the toner cartridge is attached to the frame of the drum unit, wherein the electrical contact member is electrically connected to the connector through the relay board.

* * * * *